US011741873B2

(12) United States Patent
Nijland

(10) Patent No.: US 11,741,873 B2
(45) Date of Patent: Aug. 29, 2023

(54) ADJUSTMENT OF DISPLAY OPTIMIZATION BEHAVIOUR FOR HDR IMAGES

(71) Applicant: KONINKLIJKE PHILIPS N.V., Eindhoven (NL)

(72) Inventor: Rutger Nijland, Someren (NL)

(73) Assignee: Koninklijke Philips N.V., Eindhoven (NL)

( * ) Notice: Subject to any disclaimer, the term of this patent is extended or adjusted under 35 U.S.C. 154(b) by 0 days.

(21) Appl. No.: 17/625,354

(22) PCT Filed: Jun. 30, 2020

(86) PCT No.: PCT/EP2020/068410
§ 371 (c)(1),
(2) Date: Jan. 7, 2022

(87) PCT Pub. No.: WO2021/004839
PCT Pub. Date: Jan. 14, 2021

(65) Prior Publication Data

US 2022/0262293 A1 Aug. 18, 2022

(30) Foreign Application Priority Data

Jul. 9, 2019 (EP) ..... 19185243

(51) Int. Cl.
*G09G 3/20* (2006.01)

(52) U.S. Cl.
CPC ..... *G09G 3/20* (2013.01); *G09G 2320/0626* (2013.01); *G09G 2360/16* (2013.01)

(58) Field of Classification Search
CPC ..... G09G 3/20; G09G 2320/0626; G09G 2360/16
See application file for complete search history.

(56) References Cited

U.S. PATENT DOCUMENTS 11,272,195 B2 * 3/2022 Van Der Vleuten et al. ..... H04N 19/44
2007/0201560 A1 * 8/2007 Segall ..... H04N 19/61 375/E7.184

(Continued)

FOREIGN PATENT DOCUMENTS

WO 2017108906 A1 6/2017
WO WO-2017108906 A1 * 6/2017 ..... G09G 5/02
WO 2017157977 A1 9/2017

OTHER PUBLICATIONS

International Search Report and Written Opinion from PCT/EP2020/068410 dated Jan. 14, 2021.

*Primary Examiner* — Amare Mengistu
*Assistant Examiner* — Jennifer L Zubajlo

(57) ABSTRACT

To enable a better and more adjustable manner of HDR video display adaptation, applicants inventor contributed an image pixel luminance adaptation apparatus (500), comprising: a connection (501) to a comprised or connectable video decoder (207), which video decoder is arranged to receive an encoded high dynamic range image (Im_COD), which is encoded according to a first maximum codeable luminance (PB H), and which video decoder is arranged to receive metadata specifying at least one luma mapping function (F_ct; FL_**50*t*1_1**), which at least one luma mapping function specifies the offsets of luminances of a secondary image corresponding to the encoded high dynamic range image compared to the luminances of the same pixel positions as encoded in the encoded high dynamic range image, which secondary image has a second maximum codeable luminance (PB_S) which preferably is at least 4× smaller or larger than the first maximum codeable luminance (PB_H), and the video decoder being arranged to output a decoded high dynamic range image (Im_RHDR) and the luma map- (Continued)

ping function; a display adaptation unit (401) arranged to receive a value of a display maximum luminance (PB_D) that a particular display can display as brightest pixel color, and an input luma mapping function, and the display adaptation unit being arranged to apply an algorithm which calculates at least one display adapted luma mapping function based on the input luma mapping function and the display maximum luminance (PD_D), wherein this at least one display adapted luma mapping function corresponds in shape to the input luma mapping function but lies closer to a 45 degree increasing diagonal of a graph of the input luma mapping function in perceptually uniformized axes, depending on the difference between the value of the display maximum luminance (PB_D) and the first maximum codeable luminance (PB_H) relative to the difference between the second maximum codeable luminance (PB_S) and the first maximum codeable luminance (PB_H); characterized in that the image pixel luminance adaptation apparatus comprises an alternative luma mapping function determination unit (502) arranged to determine an alternative luma mapping function (ALT_FL_**50*t*1_1) and wherein the display adaptation unit (401) comprises a combination unit (503) which is arranged to combine the at least one luma mapping function (F_ct; FL_50*t*1_1) and the alternative luma mapping function (ALT_FL_50*t*1_1) into a combined luma mapping function (CMB_FL_50*t*1_1), and wherein the display adaptation unit is arranged to apply its algorithm on as input luma mapping function the combined luma mapping function; the image pixel luminance adaptation apparatus comprising a luma mapping unit (510) arranged to receive pixel lumas of the decoded high dynamic range image (Im_RHDR) and to apply to those pixel lumas the combined luma mapping function to obtain output lumas of an output image (Im_DA); the image pixel luminance adaptation apparatus comprising an output image or video communication cable or wireless channel, to which a display can be connected, and an output signal formatter (230**) arranged to send the output image (Im_DA).

16 Claims, 8 Drawing Sheets

(56) References Cited

U.S. PATENT DOCUMENTS

2010/0177203 A1* 7/2010 Lin ..... H04N 23/60 348/222.1
2012/0201451 A1* 8/2012 Bryant ..... H04N 1/62 382/164
2013/0121572 A1* 5/2013 Paris ..... G06T 5/50 382/166
2013/0148907 A1* 6/2013 Su ..... G06T 9/004 382/238
2014/0037205 A1* 2/2014 Su ..... G06T 5/009 382/238
2016/0150145 A1* 5/2016 Van Der Vleuten ..... G09G 5/10 348/234
2016/0205338 A1* 7/2016 Kozu ..... H04N 5/57 348/687
2016/0248939 A1* 8/2016 Thurston, III ..... H04N 1/603
2016/0307602 A1* 10/2016 Mertens ..... H04N 19/46
2017/0078706 A1* 3/2017 Van Der Vleuten ..... H04N 7/0117
2018/0115777 A1* 4/2018 Piramanayagam ..... G06T 9/00
2018/0152686 A1 5/2018 Wozniack et al.
2018/0276801 A1 9/2018 Stessen
2018/0336669 A1* 11/2018 Mertens ..... H04N 5/265
2018/0374202 A1 12/2018 Cauvin et al.
2019/0052908 A1* 2/2019 Mertens ..... H04N 19/102
2019/0130542 A1* 5/2019 Tichelaar ..... G06T 5/007
2021/0360266 A1* 11/2021 Van Der Vleuten ... H04N 19/44

* cited by examiner

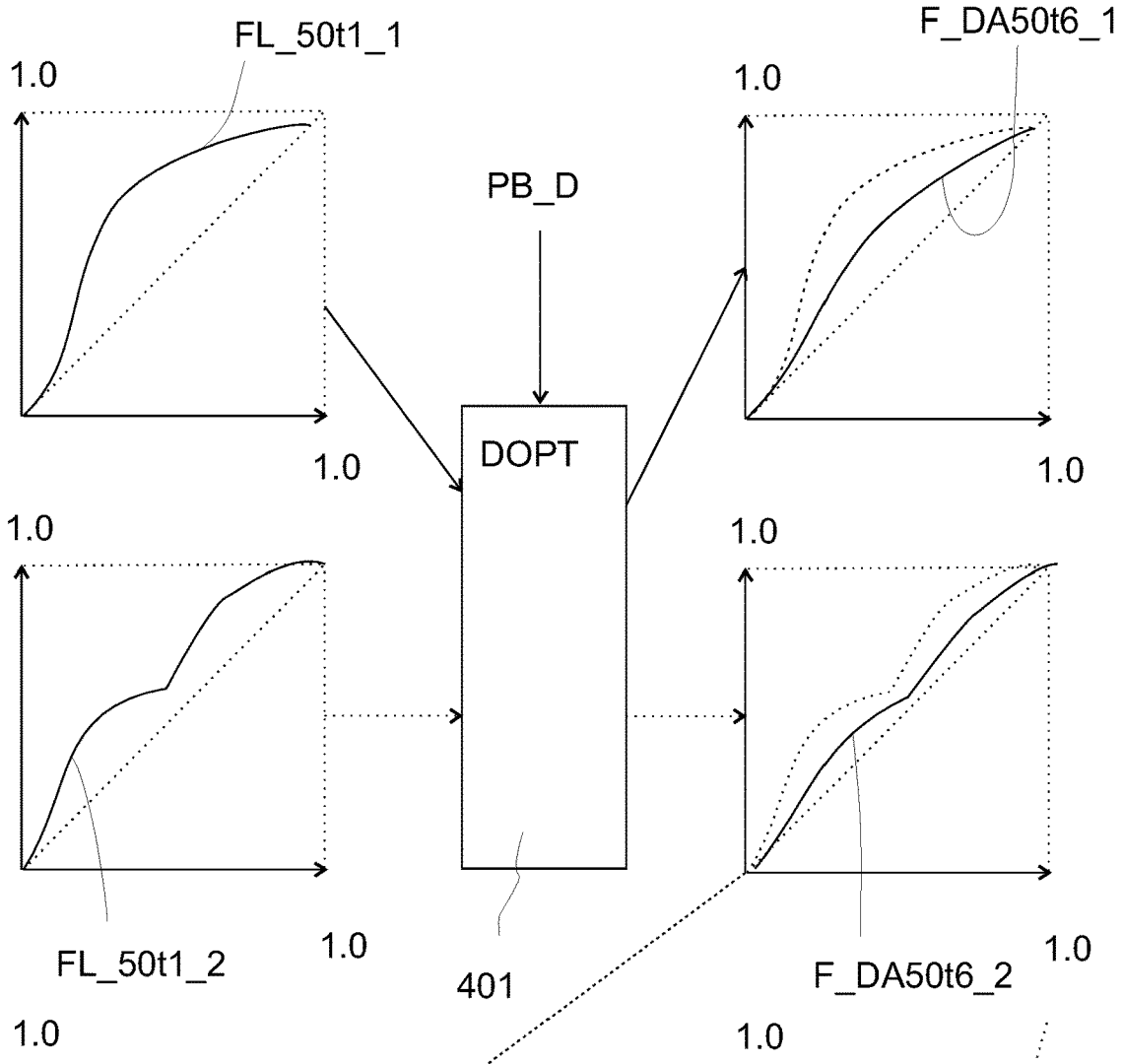
Fig. 4A
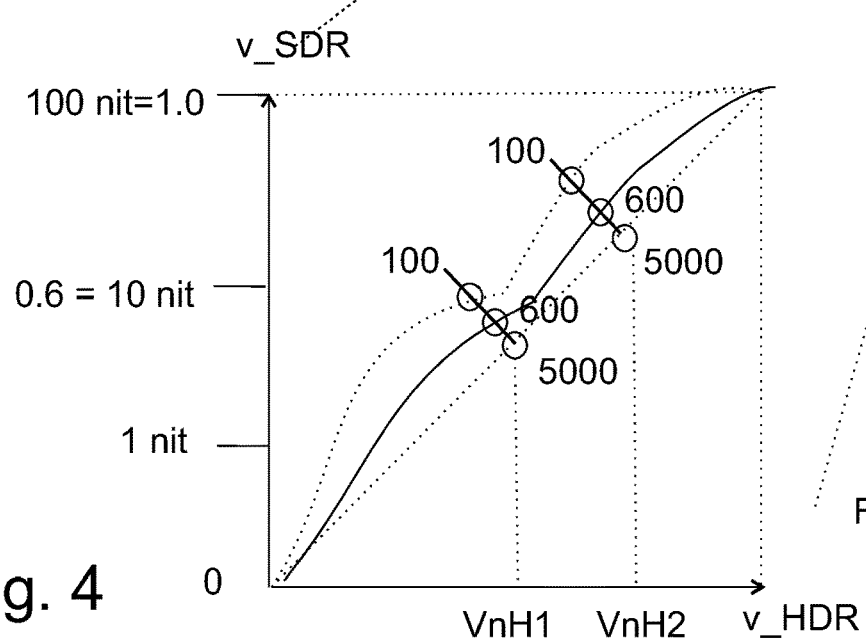
Fig. 4 B
Fig. 4

ADJUSTMENT OF DISPLAY OPTIMIZATION BEHAVIOUR FOR HDR IMAGES

CROSS-REFERENCE TO PRIOR APPLICATIONS

This application is the U.S. National Phase application under 35 U.S.C. § 371 of International Application No. PCT/EP2020/068410, filed on Jun. 30, 2020, which claims the benefit of EP Patent Application No. EP 19185243.3, filed on Jul. 9, 2019. These applications are hereby incorporated by reference herein.

FIELD OF THE INVENTION

The invention relates to methods and apparatuses for adapting high dynamic range image pixel luminances of a HDR video for a specific displaying on a display with particular luminance dynamic range and in particular its maximum displayable luminance (PB_D).

BACKGROUND OF THE INVENTION

A few years ago, novel techniques of high dynamic range video coding were introduced, inter alia by applicant (see e.g. WO2017157977).

The coding and handling of HDR video contrasts quite majorly with the legacy video coding, according to which all videos were encoded until a few years ago, which is nowadays called Standard Dynamic Range (SDR) video coding (a.k.a. low dynamic range video coding; LDR): PAL in the analogue era, and e.g. Rec. 709 MPEG2 digitally. In fact, starting with much brighter and possibly also darker image objects needing to be codeable (i.e. a larger range of pixel luminances in the starting, master HDR image created by a content creator), therefrom one experienced that one by one all the rules of video technology were revisited, and often reinvented.

Regarding the coding, the difference between HDR and SDR is not only a physical one (more different pixel luminances, to be displayed on larger dynamic range capability displays), but also a technical one of developing a different luma code allocation function (OETF), additional dynamic—per shot of images—changing metadata which specifies how to re-grade the various image object pixel luminances to obtain an image of a secondary dynamic range different from a initial image dynamic range, etc.

SDR's luma code definition, of Rec. 709, was able to encode (with 8 or 10 bit lumas) only about 1000:1 luminance dynamic range because of its approximately square root OETF function shape (luma: Y=sqrt(Luminance L)), which encoded for the typical rendering capabilities of all displays at that time. Although in the SDR era nobody cared to specify or use a maximum luminance a.k.a. coding peak brightness PB_C, the luminances of the various LDR displays in the market in the $20^{th}$ century lay closely around approximately between 0.1 darkest displayable luminance (in simple terms "black") and 100 nit ("white"), the latter being the so-called display peak brightness (PB_D).

A first HDR codec was introduced to the market, the "HDR10" codec, which is e.g. used to create the new black-ribbon jewelbox HDR blu-rays, which merely changed the OETF to a more logarithmically shaped Perceptual Quantizer (PQ) function standardized in SMPTE 2084, which allowed defining lumas for many more luminances, namely between $1/10{,}000$ nit and 10,000 nit, sufficient for all practical HDR image specification for video production (e.g. movies, television broadcast, and the like).

One should not too simplistically confuse HDR with simply a large(r) amount of bits for the luma code words (e.g. 16 bits instead of 8). That may be true for linear systems like the amount of bits of an analog-digital convertor, but since code allocation functions can have quite non-linear shape, one can now actually define HDR images with 10 bit lumas, which led to the advantage of reusability of already deployed systems (e.g. ICs may have a certain bit-depth, or video cables, etc.).

After the calculation of the lumas, one just had a 10 bit plane of pixels (or rather with the two chrominance planes Cb and Cr 3 10-bit planes), which could be classically treated further down the line "as if" they were an SDR image mathematically, e.g. MPEG-HEVC compressed, etc.

Of course the receiving side should know it gets a HDR image rather than an SDR image, or incorrect rendering will occur. E.g., if one merely mapped linearly (coded image max. luminance PB_C onto SDR display peak brightness PB_D=100 nit), an image with PB_C=1000 nit would look 10× too dark, which would mean that the night scenes become unwatchable. One can make brighter pixels by using another luminance mapping, but in general quite good care should be taken to what is best done.

Because of the logarithmic nature of the PQ OETF, HDR10 images are in principle watchable (if one interprets the luma codes as if they were normal SDR codes, i.e. displays them after applying an approximately square power EOTF), but have an ugly deteriorated contrast, making them look inter alia washed out and of incorrect brightness (e.g. a criminal who is supposed to be hiding in the dark, will suddenly appear as if lit by a ceiling of lamps).

A problem of merely coding and handling such a "mere HDR" video image (a.k.a. HDR master grading, with the word grading indicating which luminance the various scene objects/pixels should have in an image representation with a PB_C of e.g. 1000 nit (or higher), to make the HDR scene look optimal in that representation) is that it will only display correctly on a display of identical display peak brightness PB_D=1000 nit, ergo, since both displays and the PB_C of various content tends to vary ("uncontrollably") it was soon discovered that e.g. such HDR blu-ray disks don't always display perfectly, and also in this situation the night scenes may be unwatchable.

Thereto the more advanced HDR video coders encode two different dynamic range graded images a.k.a. gradings of a HDR scene: an image of higher dynamic range, e.g. of PB_C=5000 nit, and one of lower dynamic range, which is typically an SDR image having PB_C=100 nit, because that image is then immediately displayable on legacy LDR displays. The reader should understand, as will come clear below, that communicating two different graded images to receivers does not need to mean that one actually communicates two images, i.e. two sets of DCT-transformed matrixes of YCbCr pixel colors: if one co-communicates all mathematical information which allows to calculate the second image from the one of the pair (per video image presentation time instant) which is actually communicated as e.g. an MPEG-HEVC image.

Real world scenes (although an uniformly lit scene has due to the 100:1 ratio of object reflectancies only a lesser dynamic range) can have considerably high dynamic range. E.g. a cave with a small opening to the sunlit outside, may on a 10,000 nit PB_C reference representation which contains a suitable HDR grading of that scene for home television viewing, contain luminances far below 1 nit for the cave pixels, and up to 10,000 nit for at least some of the outdoors pixels. Such a challenging HDR image is not so trivially converted to considerably lower dynamic range (e.g. at least 100× when going to SDR), especially if the content creator desires to convey a still reasonably similar HDR look, also in the SDR grading, but as elucidated with FIG. 1, in principle it can be done.

For the convenience of the reader and to get him up to speed quickly on some of the aspects involved, FIG. 1 shows a couple of archetypical illustrative examples of the many possible HDR scenes a HDR system of the future (e.g. connected to a 1000 nit PB_D display) may need to be able to correctly handle, i.e. by rendering the appropriate luminances for all objects/pixels in the image.

We show the typical problems involved with dynamic range mapping, e.g. from a larger pixel luminance dynamic range to a smaller one (where we can assume that at least the peak brightness capability varies). One could liken the problem with a task of packing a number of object in ever smaller suitcases. In the biggest suitcase, one could just throw everything in disorganized, and it will fit anyway. For a middle size suitcase, one may need to decide on some optimizations, e.g. one may find that if one tightly packs the clothes in smaller compartments like separate bags, they may take up less space, and everything may easily fit again. When only using the smallest suitcase, a new set of more severe actions may be needed. E.g., if one packed books about the destination, one may tear out some pages of a second book when the same information is better explained in another book, again somehow reducing the amount of stuff to pack (it is then "comparable stuff", but not exactly as it could have been in the biggest suitcase). In case one packs just clothes, one would preferably not apply the above-mentioned best compression method of written materials, since one preferably doesn't tear out parts of the expensive clothes. Where the similarity ends for a video coding technology, is that one must find a stable, universally applicable, and fastly calculable method, to do the "image packing" on-the-fly, and even potentially different depending on the needs of various sub-ecosystems (e.g. high artistic quality Hollywood movies, versus roughly produced news material, maybe even from laymen contributors).

E.g. ImSCN1 is a sunny outdoors image from a western movie (which is characterized by having mostly or even solely bright areas, which should ideally be rendered somewhat brighter on HDR displays than on a 100 nit display, to offer more of a sunny look than a rainy day look, e.g. with an average luminance of say 500 nit), whereas ImSCN2 on the other hand is a nighttime image.

What makes such an image sunny, versus the other one dark? Not necessarily the relative luminances, at least not in the SDR paradigm. What makes HDR image rendering different from how it always was in the SDR era is that the SDR had such a limited dynamic range (about PB=100 nit, and minimum black (MB) level approximately 0.1 to 1 nit), that mostly only the intrinsic reflectivities of the objects could be shown in SDR (which would fall between 90% for good white and 1% for good black). That would be good for recognizing objects (having a certain amount of brightness from their reflection, and of course their chromaticity), under uniform technically controlled illumination, but not so much for conveying the beautiful variations in illumination itself one can have in natural scenes, and what impact that can have on viewers.

If the display allows it, and therefor so should the image coding and handling technology, one would in a forest walk really see the sun shine through the trees, i.e. rather than just a somewhat more yellow impression of some patches like on a SDR display, one would like to see bright and colorful sunlit clothes when a person walks from the shadow into the sun. And so should fire and explosions have an optimal visual impact, at least as far as the PB_D allows.

In SDR one could make the nighttime image only somewhat darker, in the luma histogram, but not too much or it would just render as too dark and ugly an image (and likely at least partly unwatchable). And additionally on a 100 nit TV or in a 100 nit encoding there just isn't any room available for anything overly bright. So one had to show the objects independent of their illumination, and couldn't at the same time faithfully show all the sometimes highly contrasty illuminations of the scene that could happen. In practice that meant that the highly bright sunny scene had to be rendered with approximately the same display luminances (0-100 nit) as a dull rainy day scene. You would have to figure out from other clues what the situation was, e.g. the viewer expecting that the cactusses are probably sunlit, hence bright. And even the night time scenes could not be rendered too dark, or the viewer would not be able to well-discriminate the darkest parts of the image, so again also those night time brightnesses would be rendered spanning the range between approximately 1 and 100 nit. A conventional solution to that was to color the night scenes blue, so that the viewer would understand he was not looking at a daytime scene. Those are in fact serious limitations of SDR imaging (other examples being e.g. the clipping to a single white of everything outside the window, so that there is nothing to see there anymore either), but somehow viewers and industrial users "got used to it", which doesn't mean there is no room for improvement.

Now of course in real life human vision would also adapt to the available amount of light, but not that much (most people in real life do recognize that it's getting dark, or that they are in a darker, or quite bright environment). Also, adapting by a technical television system is not the same as adapting by the human eye and brain, and adapting to a home displaying of content is not the same as adapting to the original scene, when being there out in the desert.

So one would like to render the images with all the spectacular local and also temporal lighting effects that one can artistically design into it, to get much more realistic rendered images at least if one has a HDR display available. What exactly would be an appropriate luminance for say a light saber in a dark room we will leave to the color grader creating the master grading(s) to decide (and when we say color grader, we mean the equivalent concept for each ecosystem, ergo not necessarily a human spending a lot of time defining the pixel luminances of both the master HDR and SDR image, but also an automatic grading for realtime broadcasting, etc.), and this application will focus on the needed technical elements to create and handle such images.

On the left axis of FIG. 1 are object luminances as one would like to see them in a 5000 nit PB master HDR grading, for a 5000 nit PB_D display (i.e. the grader makes an image assuming the typical high quality HDR TV at home will have 5000 nit PB_D, and he may actually be sitting in a representation of such a home viewing room and grade on such a 5000 nit PB_D grading reference display). If one wants to convey not just an illusion, but a real sense of the cowboy being in a bright sunlit environment, one must specify and render those pixel luminances sufficiently bright (though also not annoyingly too bright, which is a typical pitfall of HDR image creation and handling), around e.g. 500 nit (compared to the previous scene being e.g. an indoors scene). For the night scene one wants mostly dark luminances, but the main character on the motorcycle should be well-recognizable i.e. not too dark (e.g. around 5 nit), and at the same time there can be pixels of quite high luminance, e.g. of the street lights, e.g. around 3000 nit on a 5000 nit display, or around the peak brightness on any HDR display (e.g. 1000 nit).

The third example ImSCN3 shows what is now also possible on HDR displays: one can simultaneously render both very bright and very dark pixels. It shows a dark cave, with a small opening through which one can see the sunny outside. For this scene one may want to make the sunlit objects like the tree somewhat less bright than in a scene which wants to render the impression of a bright sunny landscape, e.g. around 400 nit, which should be more coordinated with the essentially dark character of the inside of the cave (because one also does not want scattering in the human eye to visually deteriorate the objects in the dark cave). A color grader may want to optimally coordinate the luminances of all objects (already in the PB_HDR=5000 nit master HDR image), so that nothing looks inappropriately dark or bright and the contrast are good, e.g. the person standing in the dark in this cave may be coded in the master HDR graded image around 0.05 nit (assuming HDR renderings will not only be able to render bright highlights, but also dark regions).

But now the question if one has these master HDR object pixel luminances, what should they be on a dynamic range which ends e.g. at 1500 nit (all luminances below 1500 nit can be faithfully represented also on this smaller dynamic range, but what about the pixel luminances above 1500 nit; in the typical behavior they will all be clipped to the same 1500 nit PB_C value, which is far from ideal).

So, as in our suitcase packing analogy, in principle there is a task for a content creator to define a large set of re-graded images starting from the master 5000 nit HDR image, e.g. a 3000 nit PB_C image, 2000, 1500, 1000, 750, 500, 300, and 100 nit image. Such a large task is of course commercially infeasible. So the present applicant has invented a technology which allows the content creator to grade only his master HDR image, and a corresponding SDR image, and all in-between images can be based thereupon be determined by an automatic technical so-called display-optimization system (see WO2017108906).

Just to illustrate some technical video coding possibilities for elucidation of some components of the present invention's concepts as detailed below, which are important to understand well, we describe an exemplary HDR video coding system which applicant has designed for HDR image and in particular HDR video coding (whereby the reader should understand the invention's principles are applicable to other systems than the exemplary system chosen for simple explanation also).

This video coding system not only can handle the communication (encoding) of merely a single standardized HDR video (e.g. 10 bit perceptual quantizer used as luma code defining EOTF for the encoding), for a typical single kind of display in the field (e.g. images defined with PB_C=1000 nit, under the assumption that every end viewer having a 1000 nit PB_D display), but it can at the same time communicate and handle the videos which have an optimal look/grading for various possible other display types with various other peak brightnesses in the field, in particular the SDR image for a 100 nit PB_D SDR display.

I.e., although in such a HDR video communication system one actually communicates only one type of graded images as transmitted pixelated images, which has various variants, of which we will elucidate in this example the one which communicates SDR images to receivers via any video communication system (but alternatively one may use a variant which communicates the HDR images), because one also adds in metadata one or more luminance re-mapping a.k.a. re-grading functions defining the HDR image pixel colors and in particular luminances from those SDR image pixel luminances, one has at the same time communicated HDR image looks for the scene also (without actually needing to communicate HDR images, like in dual image communication, or at least a second layer of pixelated HDR image data).

Thereto, a set of appropriate reversible color transformation functions F_ct is defined at the encoding side e.g. by a human color grader, as is illustrated with FIG. 2.

These functions define how to, starting from the master HDR pixel luminances (or equivalently their luma codes) get a reasonably looking SDR image (Im_LDR) corresponding to that HDR master image MAST_HDR, whilst at the same time ensuring that by using the inverse functions IF_ct the original master HDR (MAST_HDR) image can be reconstructed at any receiving side with sufficient accuracy as a reconstructed HDR image (Im_RHDR). The IF_ct functions can be determined from the forward, HDR-to-SDR mapping F_ct functions as communicated, or, the system may even directly communicate the IF_ct function(s), e.g. by the MPEG mechanism of SEI messages, or any other suitable metadata communication mechanism.

A color transformer 202 typically applies the F_ct luminance mapping of the luminances of the master HDR image (MAST_HDR) pixels, which luminances we will assume to be normalized so that the maximum luminance is 1.0 (note that one can then overlay the HDR and SDR gamut, which means that DR luminance transformations correspond to upwards or downwards shifting of the colors in this normalized gamut of codeable colors). For understanding the present invention's concepts in a simple manner, one may for simplicity assume that the F_ct HDR-to-SDR luminance mapping is a $1/4^{th}$ power luminance mapping function (L_out_SDR=power(L_in_HDR; ¼)) for deriving the normalized SDR output luminances of the pixels of the 100 nit PB_C SDR output image Im_LDR (i.e. the right side luminances of FIG. 1).

Since the receivers must be able to reconstruct the master HDR image from the received corresponding SDR image, or at least a close reconstruction but for some compression-related artefacts, apart from the actual pixelated images also the color mapping functions must subsequently enter a video encoder 203. Without limitation, we may assume that the video is compressed by this video encoder 203 using a MPEG HEVC video compressor, yielding the coded (SDR) output image Im_COD, and the functions are stored in metadata, e.g. by means of the SEI mechanism or a similar technique.

So after the action of the content creating apparatus 221, from the image communication technology perspective, the rest of the communication chain pretends it gets a "normal SDR" image as input. So e.g. a transmission formatter 204 may apply all the necessary transformations to format the data to go over some transmission medium 205 (e.g. channel coding to store on a BD disk, or frequency coding for cable transmission, etc.).

Subsequently the image data travel over some transmission medium 205, e.g. a satellite or cable or internet transmission, e.g. according to ATSC 3.0, or DVB, or whatever video signal communication principle, to one or more receiving side(s), which may be a consumer video device like a television set, or a settopbox, or a professional system like a movie theatre reception unit, etc.

At any consumer or professional side, a receiver unformatter 206, which may be incorporated in various physical apparatuses like e.g. a settopbox, television or computer, undoes the channel encoding (if any) by applying unformatting and channel decoding. Then a video decoder 207 applies e.g. HEVC decoding, to yield a decoded SDR image Im_RLDR, and unpacks the color transformation function metadata F_ct. Then a color transformer 208 is arranged to transform the SDR image to an image of any non-SDR dynamic range (i.e. of PB_C higher than 100 nit, and typically at least 4× higher).

E.g. the 5000 nit original master image Im_RHDR may be reconstructed by applying the inverse color transformations IF_ct of the color transformations F_ct used at the encoding side to make the Im_LDR from the MAST_HDR. However, also a display adaptation unit 209 may be comprised which transforms the SDR image Im_RLDR to a different dynamic range, e.g. Im3000 nit being optimally graded in case display 210 is a 3000 nit PB display, or a 1500 nit PB, or 1000 nit PB image, etc. We have non-limitedly assumed the video decoder and color transformer to be in a single video redetermination apparatus 220. The skilled reader can understand that one can similarly design a topology which communicates e.g. HDR images with PB_C=10,000 nit, and the color transformer makes output HDR images with e.g. PB_C=2500 nit, for a corresponding TV or monitor, and that various units may be connected via a network to run e.g. on different servers, etc.

The present technical components (the innovative ones according to the current teaching and/or prior art components with which they may be connected, cooperating, integrated, etc.) may be embodied or realized as various technical systems which are typical in image or video technology, i.e. e.g. in various hardware appliances. E.g. video redetermination apparatus 220 may have any technical video supply output 231, e.g. an HDMI cable that can be connected to a television display and the like (also e.g. a storage appliance, etc.; or even a network cable to communicate the output image, Im_RHDR respectively Im3000 nit, to another potentially remote device, or system, etc.). Depending on the elected physical variant, there may be an image or video output signal formatter 230, which converts the image into a single as appropriate for any technical situation (e.g. whereas we elucidate that the below core colorimetric calculation may e.g. yield a linear R,G,B representation of the pixel colors as output, the final image signal (I_out) sent e.g. to the display 210 may e.g. be HLG-formatted, and uncompressed, or MPEG or AV1 compressed, etc., as per the technical configuration, and the signal formatter 230 may contain units like e.g. typically integrated circuits responsible for taking care of all such signal derivation passes (whether fixed as a single option, or configurable).

FIG. 3 elucidates merely one example in which one may advantageously realize what for this invention is generically the color transformer 202 (respectively the color transformer 208), and this specific color calculation core may elegantly realize all the variants as one configurable core, but as far as the present innovative contributions to technology are considered that element may be designed also in various different topologies. The color is input in the color format which is quite classical for video color representation: YCbCr (be it with the addendum that in various embodiments this space may be defined from various non-linear R,G,B color triplets, e.g. gamma-2.0-defined, PQ-defined, etc.).

A chroma multiplier determiner 301 determines, depending on the luma (Y) value of any successive image pixel being processed, an appropriate multiplicative scaling factor, which the multiplier 302 will use for multiplying this scaling factor s(Y) by both input color chroma coordinates Cb and Cr, i.e. the output red chroma Cro=s(Y)*Cr of the input color, and the output blue chroma Cbo=s(Y)*Cb, with the same s(Y) factor to maintain the hue of the output color the same as the hue of the input color (whilst appropriately affecting the saturation of the pixel color). The chroma multiplier determiner 301 may be arranged to read from metadata, typically co-communicated with the communicated SDR (or other) image, MET(F_CLUT), which contains e.g. a LUT of s-factors for each possible Y value the SDR image may have. The output chroma values Cro and Cbo are input together with the luma Y in a matrix calculator 303, which uses standard 3×3 matrix coefficients (according to commonly known colorimetry, depending on which color primaries were selected, e.g. Rec. 709, or Rec. 2020 etc.) to calculate therefrom a normalized RGB representation, i.e. normalized red input component RnI, and normalized green input component GnI and normalized blue input component BnI. These will be converted to the (normalized) needed output RGB values RnO, GnO, BnO, i.e. in this example the (normalized) HDR reconstruction components.

This e.g. brightening of the pixel triplet, is effected by multiplying (by multiplier 305) the three input components by the same luma multiplier value g(Y), given any input luma Y that the pixel being processed happened to have. We have shown in above prior art that one can convert any given normalized luma to luma mapping function shape (e.g. a parabola which starts in (0,0) and ends at (1,1)) into a corresponding set of g multipliers for all possible normalized lumas Yn. This action is performed by luma multiplier determiner 304, which reads as input the metadata MET (F_PLUT) as communicated by the content creator, which codifies the shape of the luminance mapping curve, or equivalently relative luma mapping curve, or whichever is chosen.

After the multiplier 305 the pixel luminances are correctly shifted to their HDR_reconstruction relative positions, albeit still on a normalized to 1.0 gamut. Finally, an output color calculator 306 may do all necessary calculations to technically format as needed by the technical output component, e.g. a display connected via e.g. a HDMI cable, wireless communication channel, etc. It may determine the output color format RGB_DF to be e.g. in PQ-RGB format, but may also apply e.g. all kinds of optimizations when knowing the connected display is of a certain physical type (which it may not do or do differently if the output is e.g. a harddisk recording for storage for later viewing, etc.), but those details are irrelevant for the elucidation of the present invention.

FIG. 4 elucidates how the display optimization (a.k.a. display adaptation) works, for any re-grading function shape (and situation; coding embodiment) that the content creator may have elected for a particular HDR scene image (e.g. an image in which the left part is relatively dark, so that it needs RELATIVE brightening in the NORMALIZED SDR representation for the darker area, so that somebody lurking in the shadows is half-visible in both the HDR image display and the SDR image display; whilst simultaneously having enough contrast for a guy in the mist in a brighter part of that scene and its successive images, which may lead to a double curve optimizing the contrast in two regions like the FL_50t1_2 curve shown in FIG. 4).

Looking at FIG. 4A, suppose the current image (or shot of successive images) is such that the (e.g. received HDR image) is optimally re-graded to a corresponding SDR image by the specific normalized luma mapping function FL_50t_1 (note that the reader skilled in video can understand how the teachings can be formulated both in normalized luminances and in normalized lumas, merely by changing the axis, and the corresponding shape of the curve).

Without wanting to unnecessarily limit ourselves, we will continue elucidating assuming that the present explained example uses axis which are both converted to visually uniformized luminances (i.e. the equidistant steps on the horizontal and vertical axis approximately correspond to visually equal brightness differences).

According to applicant, the following equation can be used to turn luminances (or any amount of the color coordinate, like the linear amount of contribution of red primary, if one desires) into such perceptually uniform lumas v:

$$v(Ln; L\max) = \log[1 + (RHO(Lmax) - 1) * \text{power}\ (Ln; 1/2.4)]/\log[RHO(L\max)] \quad \text{[Eqs. 1]}$$

$$RHO(L\max) = 1 + 32 * \text{power}\ (L/10000; 1/(2.4))$$

In these equations L is the (normal, absolute, in nits==Cd/m^2) luminance of a pixel; Ln is the luminance normalized to 1.0 maximally, i.e. by having an Lmax which is equal to the peak brightness of the coded image PB_C, e.g. 5000 nit, and then dividing: Ln=L/PB_C.

So if we need to map e.g. 5000 nit content to SDR luminances, as shown in FIG. 4B on the vertical axis will be the output lumas v_SDR, which can be converted into luminances by using the inverse of Eqs. 1. We show this, in that by virtue of the approximately logarithmic character of the visually uniform luma representation of the luminances, on the vertical axis the decades up to PB_C_SDR=100 nit are approximately equidistant, i.e. v=0.6 approximately corresponds to 10 nit, etc.

Similarly, in case we have 5000 nit PB_C-defined HDR input, normalized lumas on the horizontal axis will approximately equidistantly correspond to 0; 1; 10; 100; 1000; and the end point 5000 just a little closer than where the 10 k position would fall.

Corresponding to this axis system, the content creator can then define a luminance remapping function shape as needed for the present image (e.g. a dark street with some street lamps, which needs some brightening of the darkest parts of the houses or shrubs in the street to keep them sufficiently visible, in the darker PB_C images corresponding to the master HDR image for rendering them of darker PB_D displays, as can be seen by the larger than 45 degree slope at the dark end of the first exemplary luma mapping (equivalent to luminance mapping) curve FL_50t1_1, as well as a display adaptation strategy for automatically deriving the curve shape needed for mapping the 5000 nit lumas to e.g. 650 nit lumas (in case a 650 nit PB_D connected display needs to be supplied with a suitably optimized/re-graded version of the master HDR image as received, or reconstructed in case an SDR representative image was communicated and received), as we will now explain.

Where there can be several variants of the display adaptation, which will all function with the present innovative technical additions of this patent application, to keep the complex discussion simple we assume that the particular display adaptation mechanism used is the one standardized by applicant Koninklijke Philips together with Technicolor in ETSI TS 103 433-2 V1.1.1 (2018 January), which for the present purposes we shortly re-summarize, also a little more generically.

The idea is that the content creator, e.g. a human color grader determining at least one of the mapping curve shape FL_50t_1 or the master HDR and SDR graded image (the skilled reader may understand that if the grader merely makes two images, applicant can also use a technology to derive how the luminances of said SDR image relate to the one of the HDR image, by an automatically derived FL_50t_1 function, but those details are again insufficiently relevant to the present discussion, so we assume the grader e.g. draws the shape of the FL_50t1_1 curve with color processing user interface tool, and checks whether this indeed gives the correct looking SDR image, or otherwise he changes the function again until it has a shape which yields the desired SDR image output), has not too much time available.

So he doesn't want to make many different re-grading curves (e.g. after making a 5000 nit best quality master HDR image, he doesn't want to make a function how to optimally re-grade to 2000 nit, and another function how to re-grade to 1000 nit, because, since these functions operate on the same master HDR image, having the same image objects having largely comparable luminance re-grading needs, normally those two functions will look relatively similar: the 5000-to-2000 mapping curve will perform a "somewhat weaker" normalized luminance shifting than the 5000-to-1000 mapping, etc.).

Ergo, although theoretically a lot can be said about all kinds of re-graded functions and images, from a technically pragmatic point of view, one may argue that for most if not all HDR images one gets sufficiently good quality medium dynamic range (MDR) images for a display of PB_D between 100 nit and the PB_C_master_HDR which in this example is 5000 nit, if one uses an automatic display adaptation algorithm which automatically calculates the in-between functions for mapping v_HDR to v_MDR (like the first exemplary display adapted function F_DA50t6_1 for creating a 600 nit PB_C MDR image), which relaxes the amount of work for the grader, because he know only needs to make (for each different archetypical image situation of course, since a cave will need a very different luma mapping function shape than e.g. a barber shop with blue light panels) one single HDR-to-SDR mapping function, e.g. the first SDR mapping function FL_50t1_1.

The display adaptation unit 401 (typically an integrated circuit performing the technical math as explained in the ESTI standard; or an equivalent system) will then derive based on this input luma mapping function and the PB_D value (600 nit in the example) calculate the needed first exemplary display adapted function F_DA50t6_1 for mapping the HDR lumas into the appropriate 600 nit PB_C MDR lumas (i.e. precisely respecting the specific luminance re-grading needs of the present image, as were communicated by the content creator as the first SDR mapping function FL_50t1_1 co-communicated with the coded HDR image in metadata, as received by unformatter 206). Similarly, if for another image the second SDR mapping function FL_50t1_2 has the different shape as indicated (and same PB_D value typically), a correctly optimized second exemplary display adapted function F_DA50t6_2 with the same generic shape (indicating specific re-grading needs of different regions or objects in the image, e.g. a dark shadowy corner, versus an area on a table under a strong lamp, etc.), yet somewhat "weaker/in-between" in the appropriate amount given the difference between PB_C_master_HDR and PB_C MDR=PB_D_available display will result.

How such a automatic display adaptation may typically work in an elegant manner, is shown in FIG. 4B. For any point on the diagonal, corresponding to some input luma, e.g. a first input luma VnH1, or a second VnH2, one may follow a metric direction, e.g. orthogonal to the diagonal, until it falls on the input function, in the example the second SDR mapping function FL_50*t*1_2. This point corresponds on this (slanted 45 degrees to the left compared to the upwards vertical) metric to the 100 nit position, because it corresponds to the function which is needed to re-grade the master HDR input lumas to the corresponding 100 nit output lumas. The PB_C_master_HDR position, which in this example is 5000 nit, corresponds to the diagonal (starting) position (which the skilled reader may understand, because a Ln_5000 to Ln_5000 re-grading corresponds to an identity transform). If one now defines a metric for the in-between positions, e.g. a logarithmic one, so that there are larger steps starting from the 100 nit position on the input luma mapping curve, and smaller steps towards the diagonal, this metric can locate all positions of a desired PB_C, e.g. 600 nit, ergo yielding all points of the curve shown non-dashed, which is hence the shape of the needed second exemplary display adapted function F_DA50*t*6_2. The only thing one must do then is to send this ("new"/optimized) curve shape to the luma multiplier determiner 304, and one can then use the color calculating engine shown in FIG. 3 to calculate all pixel lumas for the 600 nit MDR image starting from the master HDR image pixel colors as input.

This system works very nicely, and was satisfactorily demonstrated many times on many types of HDR content. However, a problem with it is that it is rather static, because of its automatic fixed algorithmic nature: one may use another variant besides the one selected for elucidation, e.g. which uses another metric, i.e. different positioning of the 100 . . . PB_C_master_HDR positions along the distance between the diagonal and the input luma mapping function position, or another direction than 45 degrees of the metric axes distributed along the diagonal, or an even more sophisticated change to the display adaptation algorithms, but given any such elected algorithm, which may typically be baked into the integrated circuit of the receiving appliance that does the display adaptation since on the fly re-configuration may be seen as rather cumbersome, the display adapted function result will always be "fixed" as it is. This could lead at least for some customers to the inconvenience that they may still find some of the images e.g. to dark, or of too little contrast, etc., at least for some of the range of possible display peak brightnesses, say PB_D<350 nit. It is important to understand that one may want to keep as technical framework constraint the luma mapping functions of the grader unchanged. One might argue that if one wants brighter images, the content creator should have made a steeper function FL_50*t*1_1 to begin with, assuming for a moment that there would never be any other issues like maybe the displaying on the brighter displays (e.g. PB_C>2500) potentially being slightly or more than slightly too bright again, or other issues near the top of the display gamut, etc.

But the content creator may argue that the functions are "his gold". The general specification, for the total set of all MDR images, upon which all secondary processing is based, may be seen as too important to tinker with, or basically "just correct" anyway (i.e. maybe somebody may find a certain display under a certain condition a little too dark, but that doesn't mean that the reference displaying of particularly the 100 nit image was incorrect, let alone that the 100 nit image itself i.e. as an image defining the content was incorrect, nor the way in which the content creator optimized this image). So pragmatically, we would like a simple manner in which the MDR image generation can be adjusted or improved, at the receiving side, by changing the display adaptation, whilst keeping all incoming image information, i.e. including the SDR mapping functions received in SEI metadata for each successive video image, unmodified.

SUMMARY OF THE INVENTION

A pragmatic manner in which to solve the staticness of the prior art display adaptation and provide some further customizability at the receiving side is realized by an image pixel luminance adaptation apparatus (500), comprising:

a connection (501) to a comprised or connectable video decoder (207), which video decoder is arranged to receive an encoded high dynamic range image (Im_COD), which is encoded according to a first maximum codeable luminance (PB_H), and which video decoder is arranged to receive metadata specifying at least one luma mapping function (F_ct; FL_50*t*1_1), which at least one luma mapping function specifies the offsets of luminances of a secondary image corresponding to the encoded high dynamic range image compared to the luminances of the same pixel positions as encoded in the encoded high dynamic range image, which secondary image has a second maximum codeable luminance (PB_S) which is smaller or larger than the first maximum codeable luminance (PB_H), and arranged to output a decoded high dynamic range image (Im_RHDR) and the luma mapping function;

a display adaptation unit (401) arranged to receive a value of a display maximum luminance (PB_D) that a particular display can display as brightest pixel color, and an input luma mapping function, and the display adaptation unit being arranged to apply an algorithm which calculates at least one display adapted luma mapping function based on the input luma mapping function and the display maximum luminance (PD_D), characterized in that this at least one display adapted luma mapping function corresponds in shape to the input luma mapping function but lies closer to a 45 degree increasing diagonal of a graph of the input luma mapping function in perceptually uniformized axes, depending on the difference between the value of the display maximum luminance (PB_D) and the first maximum codeable luminance (PB_H) relative to the difference between the second maximum codeable luminance (PB_S) and the first maximum codeable luminance (PB_H);

characterized in that the image pixel luminance adaptation apparatus comprises an alternative luma mapping function determination unit (502) arranged to determine an alternative luma mapping function (ALT_FL_50*t*1_1) and wherein the display adaptation unit (401) comprises a combination unit (503) which is arranged to combine the at least one luma mapping function (F_ct; FL_50*t*1_1) and the alternative luma mapping function (ALT_FL_50*t*1_1) into a combined luma mapping function (CMB_FL_50*t*1_1), and wherein the display adaptation unit is arranged to apply its algorithm on as input luma mapping function the combined luma mapping function;

the image pixel luminance adaptation apparatus comprising a luma mapping unit (510) arranged to receive pixel lumas of the decoded high dynamic range image (Im_RHDR) and to apply to those pixel lumas the adapted combined luma mapping function (ADJ_F_DA50t6_1) to obtain output lumas of an output image (Im_DA);

the image pixel luminance adaptation apparatus comprising an output image or video communication cable or wireless channel, to which a display can be connected, and an output signal formatter (230) arranged to send the output image (Im3000 nit).

Firstly, regarding the algorithmic or hardware specifics of the display adaptation unit, the skilled reader is informed that there may be several alternative manners in which one can calculate the generic technical essence of the HDR to PB_D-optimized medium dynamic range display adaptation, which is based on determining a function which is closer to or further from the HDR-to-SDR re-grading luma mapping function depending on where in between the first maximum codeable luminance (PB_H) and the second maximum codeable luminance (PB_S) the value of the display maximum luminance (PB_D) lies for which the display adaptation unit (401) must calculate an optimally adapted image and its pixel luminances or lumas, ergo equivalently also how close the resultant display adapted luma mapping function will lie to the diagonal. Also, there may be some variants in how exactly one defines the (approximately) perceptually uniformed lumas: although such functions will be approximately logarithmic in nature, as the example shows, one can vary the parameters of the logarithmic function, and the algorithm will still work the same, and yield an image which looks good. Ergo, the skilled person understands that these details don't form the essence of our present innovative contribution, and can be varied whilst still giving the same kind of, identifiable apparatus. Also the skilled person understands that the apparatus can be a standalone image color optimization apparatus, i.e. which is to be operatively connected to a separate video decoder (which will obtain and decode to supply as required all data, i.e. the image pixel color data, which we may assume to be e.g. in linear RGB representation, or for elucidation simplicity in YCbCr which is calculated with the well-known matrix based on R,G,B non-linear component values, which may e.g. be PQ-encoded; and the metadata which contains at least one luma mapping function to be used by the display adaptation unit's final luma mapping calculation algorithm), or the apparatus may be a total system comprising everything (which may e.g. all be embodied as a television display, etc.). The secondary (graded reference) image is an image at the other end of desired dynamic ranges to be covered, so for a e.g. 4000 nit PB_C master HDR image this will typically be a 100 nit PB_C SDR image, no matter which one of the two is actually communicated (although the display adapted final MDR image can also be calculated starting from the SDR image, for simplicity we will in the elucidation assume it is calculated from the HDR image, i.e. to a lower dynamic range (or at least max. luminance assuming the minimum black of the input and output image is the same) unless there is an extrapolation to a more impressive somewhat higher dynamic range than the originally created image). Typically it makes sense to make the dynamic ranges of the content creator's two reference gradings, i.e. typically their PB_C values, differ at least by a multiplicative factor of four, otherwise there is not so much sense to do at least a technically high quality display optimization, although in principle one can apply the same principles even with smaller differences between the various image gradings. The display maximum luminance may be input for the display adaptation unit (401) in various manner again depending on the technical realization variant. E.g., a settopbox may poll which one of various displays is connected, and then the display may communicate a value of its PB_D back into the STB prior to starting the color optimization and image or video output towards the connected television display (or a user may input what he thinks is the value, or a least a good working value for his t.v. via a STB User interface, etc.). On the other hand if the apparatus is a television itself, then it's unique PB_D value (e.g. relating to the backlight behind the LCD display panel, or a value which the TV manufacturer considers safe to use to not overheat the OLED panel, etc.) may be already stored inside the display adaptation unit (401) in an unmodifiable memory, i.e. compared to our generic mere schematic elucidation in such a case the unit 401 receives the PB_D value from itself. Again such variable aspects are not really material to identifying when an apparatus is of the type as invented and herein described.

The alternative luma mapping function determination unit (502) may be using a number of (simple) fixed strategies to determine a good alternative luma mapping function (ALT_FL_50t1_1). E.g., for many applicants of the technology it may already be enough to do something as simple as the brightening of the darks, like via the Para Shadowgain ("Para" being the name of a specific luma mapping curve with a linear slope at both the dark 0,0 and bright end 1,1, and with a smooth parabolic segment connection those linear parts in the middle) alternative exemplified with FIG. 7, or a simple contrast modification, etc., but now, depending on the PB_D, i.e. instead of doing it "on the content" (i.e. the pair of extreme-end HDR and SDR reference gradings, and the luma mapping function(s) linking them), the control can be done dependent on which part of the span of PB_D capable displays needs more or less correction. There is an advantage in doing the adjustment prior to the fixed display adaptation rather than later (one could also e.g. display adapt both the Para received from the content creator in the metadata of the communicated signal and the alternative para proposed by the receiving side i.e. e.g. the tv itself, and then correct the display-adapted para with the display-adapted alternative), because doing it prior still has the function go through the standard display adapted behaviour, e.g. the logarithmic positions on the metric of the various PB_Ds which vary more near SDR where much adjustment is needed and have an "almost perfect HDR" behaviour for high PB_D displays.

The skilled reader should also have not too much difficulty understanding when there can be several functions (as usual, a claim should be read formulated operating on its least-detailed embodiment, i.e. just one image being processed with just one original, content creator-derived luma mapping function, and just one alternative luma mapping function, to derive only one final, optimal display adapted luma mapping function, ready to be loaded or applied in the color processor to obtain the best MDR image corresponding to the HDR master image in look (i.e. relative luma position of the various image objects and general color impression), for the particular sole display of PB_D that needs to be supplied with the display adapted MDR image.

One can create multiple different luma mapping functions for successive images to be presented one after the other in time, and then the display adaptation unit will make several successive display adapted luma mapping functions corresponding to each respective one of the input luma mapping functions, as they were created by the content creator. The display adaptation unit may also make several output display adapted luma mapping function for one single input luma mapping function, if it needs to serve two output video streams, e.g. one to a high quality 1500 nit PB_D HDR display, and another one simultaneously to a portable display on which the other member of the family is following the show in the kitchen.

What may be a little more complex to understand (and not necessary for understanding the present technical contributions by themselves, at least from a patenting point of view, but useful for completeness) is that a luma mapping function may consist of a number of partial luma mapping functions, which are defined to be applied in succession. E.g., a content grader may apply the Para to do a coarse grading, which roughly balances the dark regions and the bright regions. I.e. when mapping a scene with two quite differently illuminated regions, e.g. indoors which is typically 100× darker in nature than outdoors, and maybe e.g. 10× darker in the HDR reference grading depending on how the content creator mapped the real world to his master HDR image, the Para can be used to brighten the darks relatively to the brights, thereby squeezing the contrast of the bright region somewhat, which is a nice simple manner (and often on much content already quite good) to make a lower dynamic range version of a higher dynamic range image. However, outside there may be a commercial sign which is embodied as white text applied (e.g. sandblasted) on a glass panel. When reducing the contrast by an oversimplified approach, like the upper slope of the Para which must be small to make room in the small luminance range of the SDR second reference grading for all darker object/pixel lumas, this text may become badly readable. According to applicant's principles the content creator/coder may solve this by applying after the Para a customizable curve (CC) which brings in more contrast again exactly around the luma positions of the white text and the whitish colors surrounding of/behind/reflecting on the glass, so that the text becomes quite readable again (note also the difference between calculation precision versus coding word length etc., but such details need not be explained here).

For the present new teachings, one can understand that the succession of a number of luma mapping curves is by itself again a luma mapping curve, so one could pretend there was only one "full" curve (in fact, if the reader wants to keep things simple for understanding the present patent application, he may assume that the grader used only a Para, without a CC). But it is possible to do the display adaptation not just on the full luma mapping function, but with specific math on the partial luma mapping curves themselves, for which we refer the reader to ETSI TS 103 433-2 V1.1.1 (2018 January) paragraph 7.3 "metadata recomputation" in case of interest.

No matter how one embodies the details, the present innovative improvement is about having a quite elegant adjustment mechanism, for something which for technical framework limitation reasons was preferred to be realized relatively static (as explained).

In more advanced embodiments, the function determination unit 502 can analyse various specifics of the input image (overall luminance distribution characteristics, segmentation into various regions and analysing geometric structures and contrast measures of those like e.g. integrated derivatives, texture characteristics, etc.) and therefrom derive an adjustment, which it formulates as an alternative luma mapping function shape.

The combination unit 503 can also apply the combination in several variants, which the skilled reader can understand based on our example, but oftentimes such a simple linear weighting combination is sufficiently good in practice (technologists like the simpler variants, which require less transistors and power, but of course alternative embodiments could be derived also), the more interesting part being in controlling how this combination will depend on the PB_D situation. With combination we don't mean the broadest possible concept, where e.g. only a part of a curve is exchanged for a part from another curve, but that all or most of the lumas get a new curve output which depends on both the output as formulated in the first curve and the output as formulated in the second curve or prescription.

A good advantage comes in when the image pixel luminance adaptation apparatus (500) has the combination unit determine the combined luma mapping function to be more similar in shape to the alternative mapping function respectively the at least one luma mapping function depending on the value of the display maximum luminance (PB_D). One can then control e.g. more mixing of an alternative behaviour which corrects a certain relative luma repositioning for the smaller PB_D values, and the reader can understand we may want to do this in several manners, potentially with a complicated formulation of what is specifically done in which situation (e.g. the alternative luma function may correct for two luma repositioning aspects, a first one being controlled to a first degree, e.g. only within a certain sub-range of the total PB_D range to be handled and not for higher than PB_D_lim PB_D values, whilst the second aspect, typically corresponding to another luma sub-region is controlled in a different manner, i.e. has a different PB_D-dependent combination behaviour, etc.). E.g. the combination unit can check the PB_D value, and then whichever combined mapping function behavior determination it applies, it may check whether the PB_D value is within a certain percentual deviation from a maximum PB_D (e.g. PB_HDR of the input image), and then perhaps perturb the original function a little according to the shape of the alternative function, but e.g. stay within a certain band around the first function. For PB_D values below PB_D1 it may start seriously deviating, and below PB_D2 even mostly follow the shape of the alternative function. Other algorithms for coming to such a PB_D-dependent function combination behavior are also possible. This enables more control over the difficult task of displaying high dynamic range images when having only lower dynamic range, in fact display peak brightness, displays.

A pragmatically simple yet well-working variant of the image pixel luminance adaptation apparatus 500 has the combined luma mapping function being determined by the combination unit by linear weighting per luma value defined as: CMB_FL_**50*t*1_1**(Vn)=(1−A)*FL_**50*t*1_1**(Vn)+A*ALT_FL_**50*t*1_1**(Vn), in which Vn is a perceptually uniformized luma representation of a pixel luminance which can be applied by applying a logarithmic function to the luminance, and A is a weight value between zero and one, which is derived based on the value of the display maximum luminance (PB_D) by applying a function which sets A equal to zero below a low display maximum luminance (PLOW) and sets A equal to one above a high display maximum luminance (PHIG), and sets A equal to a value between zero and one if the display peak brightness is between the low display maximum luminance (PLOW) and the high display maximum luminance (PHIG) according to a preset weighting function shape. The values of PLOW and PHIG can then be fixed, or optimized in intelligent manner, depending on what would give good results, either generically on average for all images, or for specific types of images (e.g. classified based on specifics of the luma histogram, such as largely bright with a small dark object, i.e. a small number of dark pixel lumas, versus a largely dark image, etc.).

The reader understands that other formulations of the needed adjustment as an alternative luma mapping function and weight definitions can be formulated.

In such a case the function determination unit 502 (juncto what the combination unit will do) will generally take care that the alternative function also has largely the shape needed for doing the appropriate HDR-to-MDR regrading. Often the method will be applied to do some minor adjustments anyway. As regards the (near)-HDR MDR images, the working of the display adaptation itself will guarantee the correct behaviour (close to the diagonal) no matter what alternative respectively final function is used, also because of the logarithmic nature of its metric.

A pragmatic simple embodiment of the image pixel luminance adaptation apparatus may use as preset weighting function shape a linearly increasing shape between zero and one when defined on an input axis which is measured in the perceptually uniformized luma representation. Again, one may fix one of several (largely similarly working) perceptual luma representations, and the apparatus will function in the same manner, the election being dependent on variables which matter not for this patent application (ergo without wanting to limit, the reader may assume it is the representation of luminances as perceptually uniformized lumas that can be calculated by the example Eqs. 1).

The following specific embodiment may already give enough display adaptation quality adjustment for many customers and/or market situations: an image pixel luminance adaptation apparatus (500) as claimed in one of the above claims in which the at least one luma mapping function (F_ct; FL_50*t*1_1) is at least partially defined by means of a luma mapping function which consists of a first linear segment for a darkest sub-range of a total input luma range, the linearity aspect being fulfilled in the perceptually uniformized luma representation, a second linear segment for a brightest sub-range of the total input luma range, and a non-linearly shaped non-decreasing segment for a middle sub-range in between the darkest sub-range and the brightest sub-range which connects at both ends with the linear segments, and wherein the alternative luma mapping function (ALT_FL_50*t*1_1) comprises at least an first alternative linear segment for the darkest sub-range which has a slope different from a slope of the first linear segment for a darkest sub-range of the at least one luma mapping function. Ergo, one merely corrects the coarse Para, when having a fine-grading CC second partial luma mapping curve taking care that this fine-grades the lumas of the same objects, i.e. shifted to their new luma sub-ranges compared to the originally specified sub-ranges by the fact that display-adapted Para's do a different coarse balancing i.e. relative re-positioning of said sub-ranges.

The end-luma of the darkest (and brightest) linear segment may be the same for the original, creator's Para and the alternative Para, or different.

Note that the PB_H first max. luminance of the master HDR image (even if communicated as a corresponding SDR image) is typically also communicated, and the SDR max. luminance may be pre-fixed hence known, typically equal to 100 nit, but may also be varied and communicated, and the present embodiments work similarly.

The various technical realizations may also be embodied as:

A method of pixel luminance adaptation comprising:

receiving an encoded high dynamic range image (Im_COD), which is encoded according to a first maximum codeable luminance (PB_H), and receiving metadata specifying at least one luma mapping function (F_ct; FL_50*t*1_1), which at least one luma mapping function specifies the offsets of luminances of a secondary image, corresponding to the encoded high dynamic range image, compared to the luminances of the same pixel positions as encoded in the encoded high dynamic range image, which secondary image has a second maximum codeable luminance (PB_S) which preferably is at least 4× smaller or larger than the codeable luminance (PB_H);

decoding the encoded high dynamic range image (Im_COD) into a decoded high dynamic range image (Im_RHDR);

receiving in a display adaptation step a value of a display maximum luminance (PB_D) that a particular display can display as brightest pixel color, and the luma mapping function, and the display adaptation step applying an algorithm which calculates at least one display adapted luma mapping function based on the luma mapping function and the display maximum luminance (PD_D), wherein this at least one display adapted luma mapping function corresponds in shape to the input luma mapping function but lies closer to a 45 degree increasing diagonal of a graph of the input luma mapping function in perceptually uniformized axes, said closeness to the diagonal depending on the difference between the value of the display maximum luminance (PB_D) and the first maximum codeable luminance (PB_H) relative to the difference between the second maximum codeable luminance (PB_S) and the first maximum codeable luminance (PB_H);

characterized in that the method comprises determining an alternative luma mapping function (ALT_FL_50*t*1_1) and wherein the display adaptation step comprises combining the at least one luma mapping function (F_ct; FL_50*t*1_1) and the alternative luma mapping function (ALT_FL_50*t*1_1) into a combined luma mapping function (CMB_FL_50*t*1_1), and wherein the display adaptation step is arranged to apply its algorithm on as input luma mapping function the combined luma mapping function, yielding an adapted combined luma mapping function (ADJ_F_DA50*t*6_1);

receiving pixel lumas of the decoded high dynamic range image (Im_RHDR) and applying to those pixel lumas the adapted combined luma mapping function (ADJ_F_DA50*t*6_1) to obtain output lumas of an output image (Im_DA);

outputting an output image (Im3000 nit) which results from applying the adapted combined luma mapping function to the pixel lumas of the decoded high dynamic range image (Im_RHDR) on an image or video communication cable or wireless channel, to which a display can be connected.

A method of image pixel luminance adaptation of the generic type in which in addition the combined luma mapping function is determined to be more similar in shape to the alternative mapping function respectively the at least one luma mapping function depending on the value of the display maximum luminance (PB_D).

A method of image pixel luminance adaptation as mentioned hereabove, in which the combined luma mapping function is determined by linear weighting per luma value defined as: CMB_FL_50*t*1_1(Vn)=(1−A)*FL_50*t*1_1(Vn)+A*ALT_FL_50*t*1_1(Vn), in which Vn is a perceptually uniformized luma representation of a pixel luminance which can be applied by applying a logarithmic function to the luminance, and A is a weight value between zero and one, which is derived based on the value of the display maximum luminance (PB_D) by applying a function which sets A equal to zero below a low display maximum luminance (PLOW) and sets A equal to one above a high display maximum luminance (PHIG), and sets A equal to a value between zero and one if the display peak brightness is between the low display maximum luminance (PLOW) and the high display maximum luminance (PHIG) according to a preset weighting function shape.

A method of image pixel luminance adaptation in which the preset weighting function shape is a linearly increasing shape between zero and one when defined on an input axis which is measured in the perceptually uniformized luma representation.

A method of image pixel luminance adaptation in which the at least one luma mapping function (F_ct; FL_50t1_1) is at least partially defined by means of a luma mapping function which consists of a first linear segment for a darkest sub-range of a total input luma range, the linearity aspect being fulfilled in the perceptually uniformized luma representation, a second linear segment for a brightest sub-range of the total input luma range, and a non-linearly shaped non-decreasing segment for a middle sub-range in between the darkest sub-range and the brightest sub-range which connects at both ends with the inner ends of the linear segments, and wherein the alternative luma mapping function (ALT_FL_50t1_1) comprises at least a first alternative linear segment for the darkest sub-range which has a slope different from a slope of the first linear segment for a darkest sub-range of the at least one luma mapping function.

A maximum codeable luminance means the physical luminance that corresponds to the maximum codeable pixel color, i.e. the highest luma code (e.g. 1023 in 10 bit), i.e. the actual luminance of the whitest white, as it should ideally be displayed on any display, and may be displayed on a corresponding virtual display associated with the image. I.e. the virtual display may indicate that the brightest codeable luminances of the image(s) is e.g. 1200 nit, and ideally if one has an actual receiving-side (e.g. consumer) display of 1200 nit max. displayable white or more, such a display should render the highest luma code achromatic pixels with a displayed luminance of 1200 nit. The co-communicated function can then have a content-creator-optimized function shape indicating how such image luminances (lumas in fact typically) should be displayed on a display with lesser max. luminance capability, e.g. 600 nit display, e.g. by mapping the highest image luma to the highest possible displayable luminances, and below this using a larger sub-range for the darker color than for the brighter colors, etc. It is understood that image creators can compose the relative luminance position of various image objects differently depending on the maximum codeable luminance PB_C, e.g. for a 4000 nit PB_C one can make lamps much brighter compared to the non-emissive image object pixel luminances than for a 900 nit PB_C. One can also see this as pixel luminances of one object, e.g. the lamp, being offsetted to new relative positions compared to e.g. an indoors chair object pixel luminance, for various PB_C image codings, on the normalized to 1.0 luminance (or even luma, via the EOTF which defines the luminances corresponding to the various luma codes) axis.

BRIEF DESCRIPTION OF THE DRAWINGS

These and other aspects of the method and apparatus according to the invention will be apparent from and elucidated with reference to the implementations and embodiments described hereinafter, and with reference to the accompanying drawings, which serve merely as non-limiting specific illustrations exemplifying the more general concepts, and in which dashes are used to indicate that a component is optional, non-dashed components not necessarily being essential. Dashes can also be used for indicating that elements, which are explained to be essential, but hidden in the interior of an object, or for intangible things such as e.g. selections of objects/regions (and how they may be shown on a display).

In the drawings:

FIG. 4 schematically elucidates the basic technical aspects of the display adaptation process, which is typically elected to be a simple, fixed automatic process, based on, for any possible input luma mapping function shape (of which two examples FL_50t1_1 and FL_50t1_2 are shown), which function codifies how one must re-grade the normalized to 1.0 lumas from a first to a second representative grading of a HDR scene (typically a master HDR image which a certain max. codeable luminance, PB_C=e.g. 5000 nit, and a 100 nit PB_C SDR image on the other hand), deriving as output a corresponding (preserving the essentials of the function shape) final display adapted luma mapping to be used to determine an MDR image from the HDR image pixel lumas, which MDR image has the correct relative lumas for driving an MDR display with 100<=PB_D<=PB_C optimally, so that as far as differences in display capability allow so, the MDR image looks reasonably similar to the HDR image when shown on a high quality HDR reference display with PB_D_HDR_reference=PB_C;

DETAILED DESCRIPTION OF THE EMBODIMENTS

Figure 5:
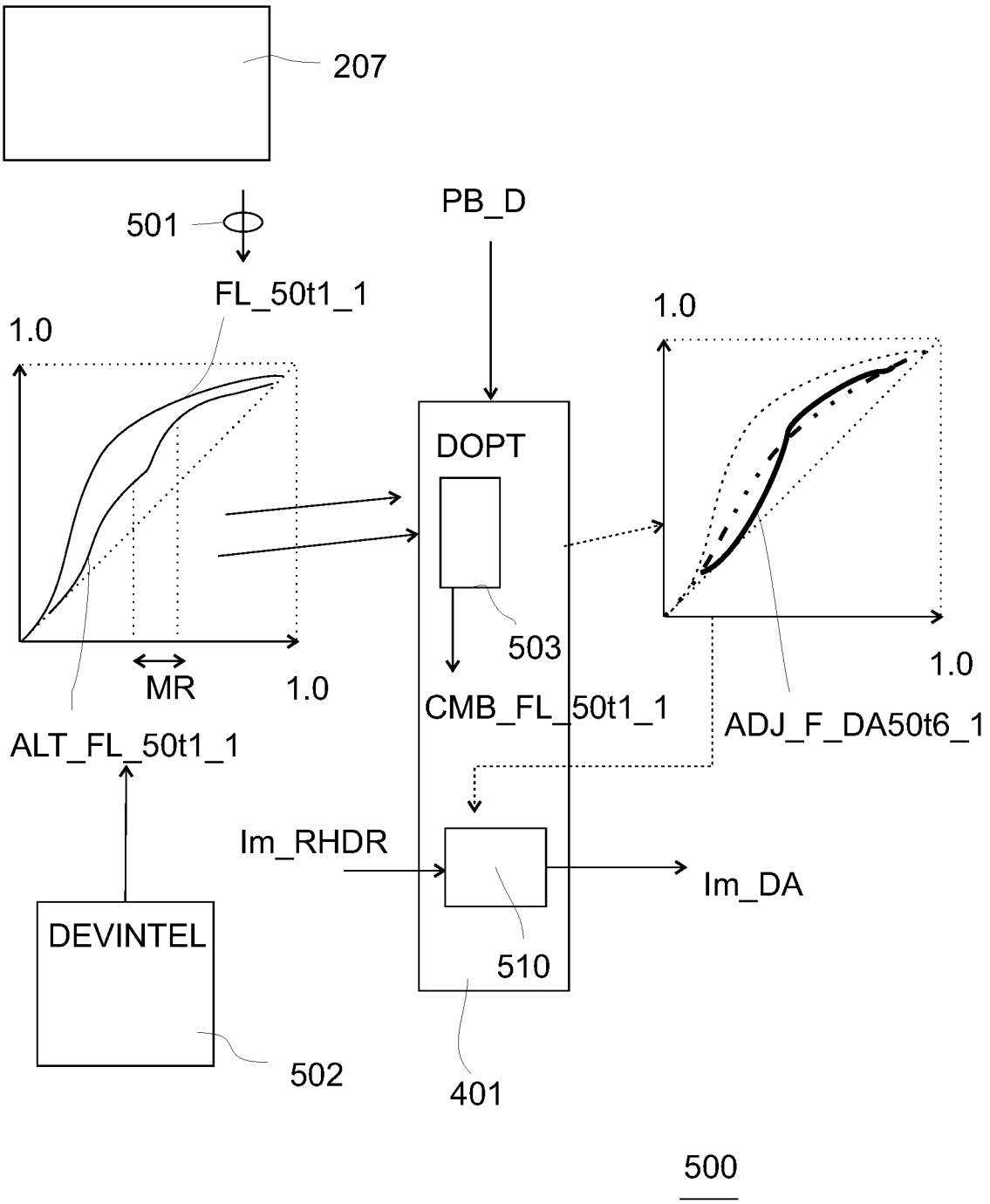
FIG. 5 shows how according to the present inventor's insights, such a display adaptation process or unit can be further improved to be adjustable, by supplying to it not just the original content creator's luma mapping function, but also a suitably shaped alternative luma mapping function (ALT_FL_**50*t*1**; for each image re-grading needs situation), so that the display adaptation unit can realize a less static re-grading behavior for the various possible actual PB_D values, and how e.g. a certain image may still look a little too dark on some displays, e.g. with PB_D<550 nit, whilst simultaneously maybe still a little too bright on other displays, e.g. with PB_D>1500 nit.

FIG. 5 shows generically which integrated circuits or similar units the improved display adaptation unit of the image pixel luminance adaptation apparatus 500 of the present patent application will be composed of.

As already described above, the novel image pixel luminance adaptation apparatus 500 will comprise an alternative luma mapping function determination unit 502. Depending on which apparatus this resides in (e.g. settopbox preparing the image for a particular tv, or in the tv itself, etc.) this unit can formulate the alternative luma grading function shape ALT_FL_**50*t*1_1** in various manners, e.g. ranging from a function which is not or hardly dependent on either the contents of the image or the content creator's SEI-communicated luma adaptation function, or this function can largely follow the shape of the SEI-communicated luma adaptation function and have only one aspect varied (e.g. slightly), e.g. lie a little higher in the v_input, v output graph, or have some shape perturbation in a small sub-range of v_input, etc.

This can be by a fixed amount designed in by the technology provider or apparatus manufacturer, or be a variable amount, potentially determined on-the-fly, e.g. per image, etc.

The alternative luma mapping function (ALT_FL_**50*t*1_1) and the original one (FL_50*t*1_1) as determined by the content creator as re-grading need indicating function and received (typically extracted by decoder video 207, which video decoder is comprised in the apparatus 500, or at least connected to it during operation, so that the function can be received via input 501), are combined (in combining unit 503) by any manner to yield an combined grading function CMB_FL_50*t*1_1, which implements a little of both functions, depending on the need of display adaptation, i.e. typically the specific value of the connected display's PB_D. Note that the input 501** may double as input for the decoded image Im_RHDR, or there may be a separate input for this image from the comprised or connectable decoder.

In the elucidation example we see that the original function is a somewhat coarse shape (e.g. a pure Para or the like), which mostly implements a relative brightening of the darkest luma (for lower PB_C MDR images, or more precisely for the SDR grading). The alternative function implements some contrast stretch in perceptually uniform input sub-range MR, e.g. because there is a critical object there that doesn't easily re-grade well on the darkest, i.e. lowest PB_D displays. We see that this behaviour then leaks through in the display adapted combined combined luma mapping function (ADJ_F_DA**50*t*6_1**) because the standard display adaptation algorithm is of static and known origin, and can so lead to the adjustment as needed.

Finally, the adapted combined luma mapping function ADJ_F_DA**50*t*6_1 is used (as input) by the luma mapping unit 510**, which uses this specification to map the lumas of the reconstructed/decoded HDR image Im_RHDR into the optimally corresponding, display adapted output lumas of display adapted image Im_DA, which can be sent to any image or video output depending on the specific technical realization of the particular image or video handling apparatus or system.

Figure 6:
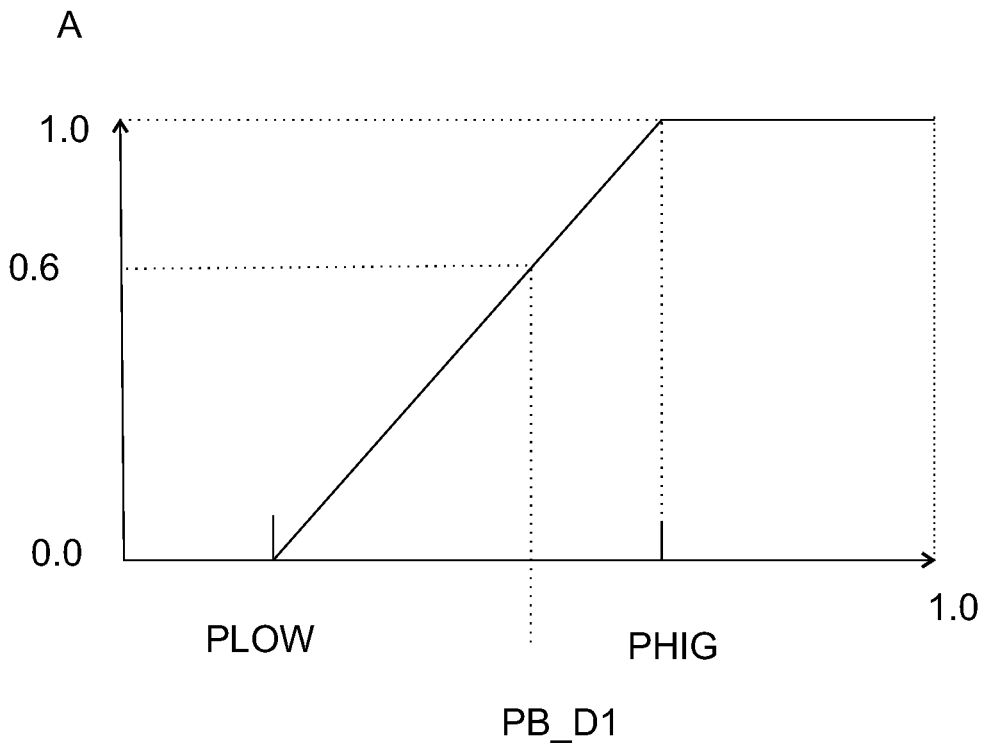
FIG. 6 shows an elegant an easy manner to specify how the system should act for various PB_D values which can occur at the receiving side, namely, how the original and alternative luma mapping function may be combined into a single combined function, prior to applying (any variant which happened to be present hence fixed in e.g. a television set) the fixed display adaptation algorithm on that combined function.

FIG. 6 shows generically an advantageous manner to weigh the two luma functions per luma. E.g. for the specific PB_D value equal to PB_D1, the resultant weight factor A for the adjustment is A=0.6

For all normalized to 1.0 perceptual uniform lumas (Vn) that can occur in the input images, the combined function can then be calculated as:

$$\text{CMB_FL_50}t1_1(Vn;\text{PB_D1}) = 0.6*\text{FL_50}t1_1(Vn) + 0.4*\text{ALT_FL_50}t1_1(Vn)$$

This combined function can then be inputted into the standard algorithm of the display adaptation, as if, but whilst it is explicitly not, it was the original content creator's luma mapping function (i.e. as if we were performing a standard display adaptation).

Figure 1:
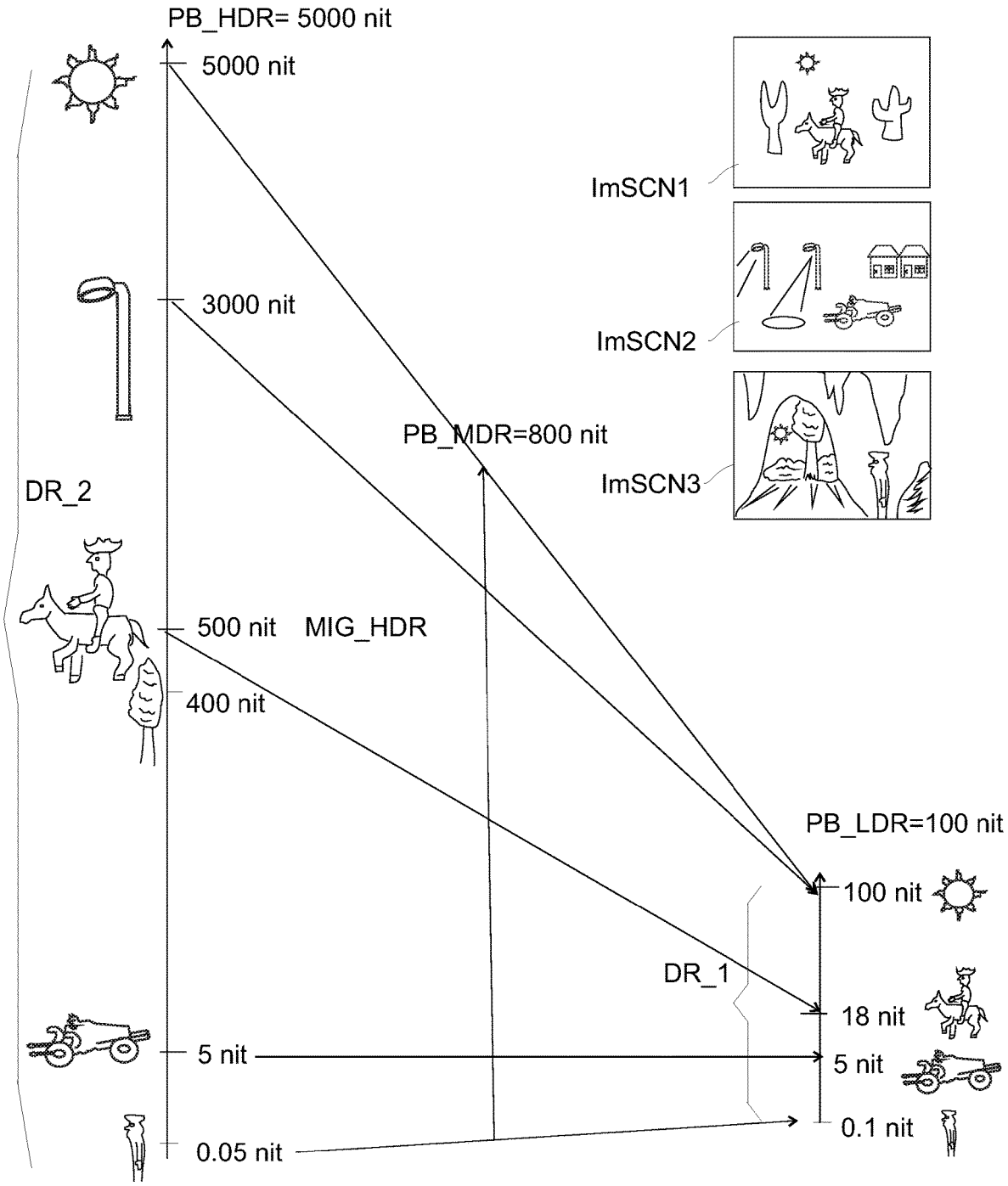
Fig. 1 Prior Art
FIG. 1 schematically illustrates a number of typical luminance transformations which occur when one optimally maps a high dynamic range image to a corresponding optimally color graded and similarly looking (as similar as desired and feasible given the differences in the first and second luminance dynamic ranges DR_1 resp. DR_2) lower dynamic range image, e.g. a standard dynamic range image of 100 nit peak brightness, which in case of reversibility (e.g. SL-HDR1 coding which communicates the SDR variant of the HDR image, which still needs to be reconstructed into the HDR image by receivers by applying the inverse of the luma mapping function which created the SDR lumas from the HDR lumas, on the received SDR image lumas) would also correspond to a mapping of an SDR image as received which actually encodes the HDR scene, to a reconstructed HDR image of that scene.
Figure 2:
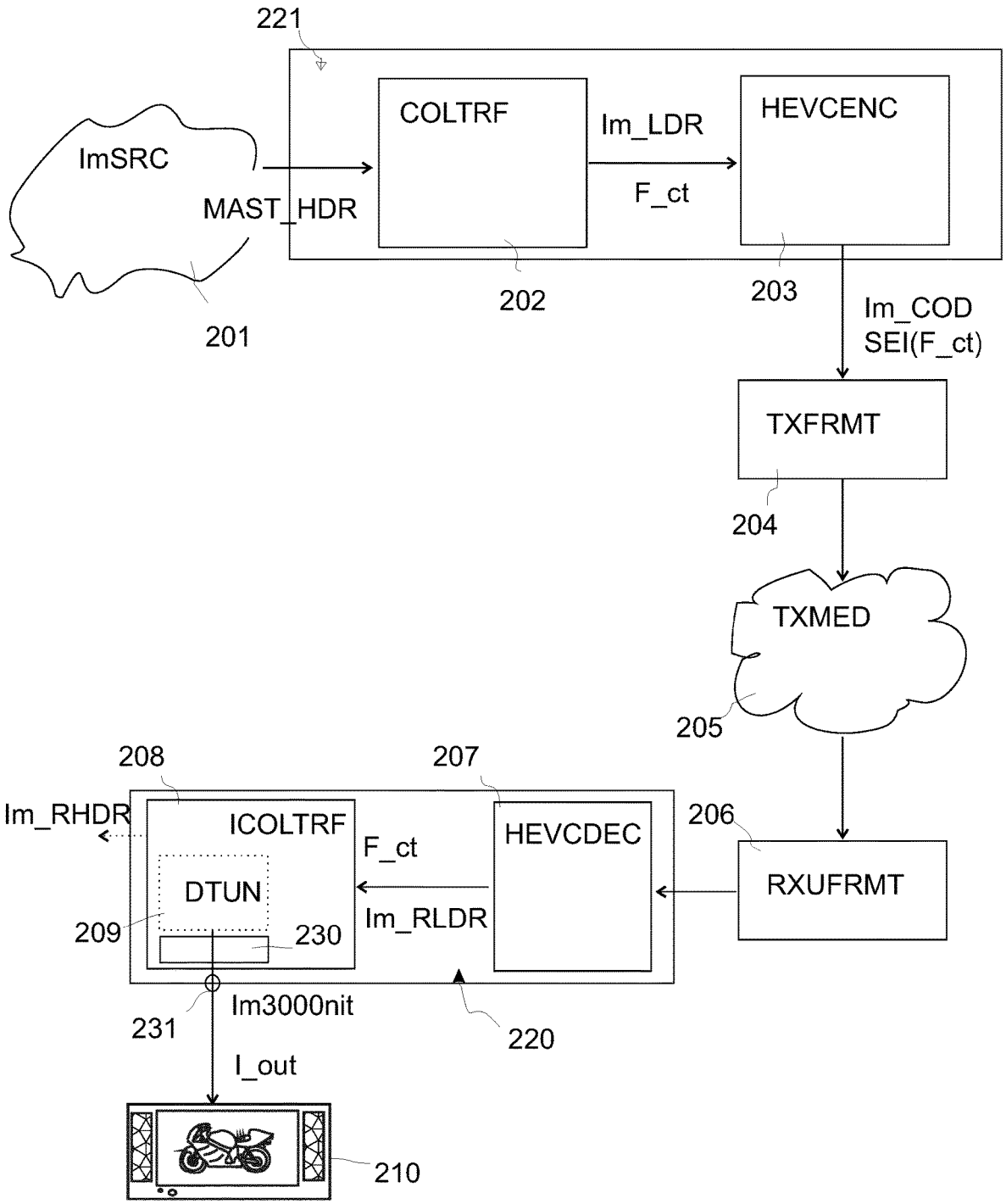
FIG. 2 schematically illustrates an satellite-view example of a technology to encode high dynamic range images, i.e. images capable of having luminances of at least 600 nit (i.e. at least 6× the PB_C of the SDR image) typically or more (typically 1000 nit or more, e.g. 2000 nit maximally occurring/codeable pixel luminance PB_C or 10,000 nit PB_C), which the present applicant recently developed, which can actually communicate the HDR image(s) as an SDR image plus metadata encoding color transformation functions comprising at least an appropriate determined luminance transformation for the pixel colors (typically technically embodied as a luma mapping function, in a perceptually uniformized luma domain), to be used by the decoder to convert the received SDR image(s) into HDR images(s) which are a faithful reconstruction of the original master HDR image(s) created at the image creation side.
Figure 3:
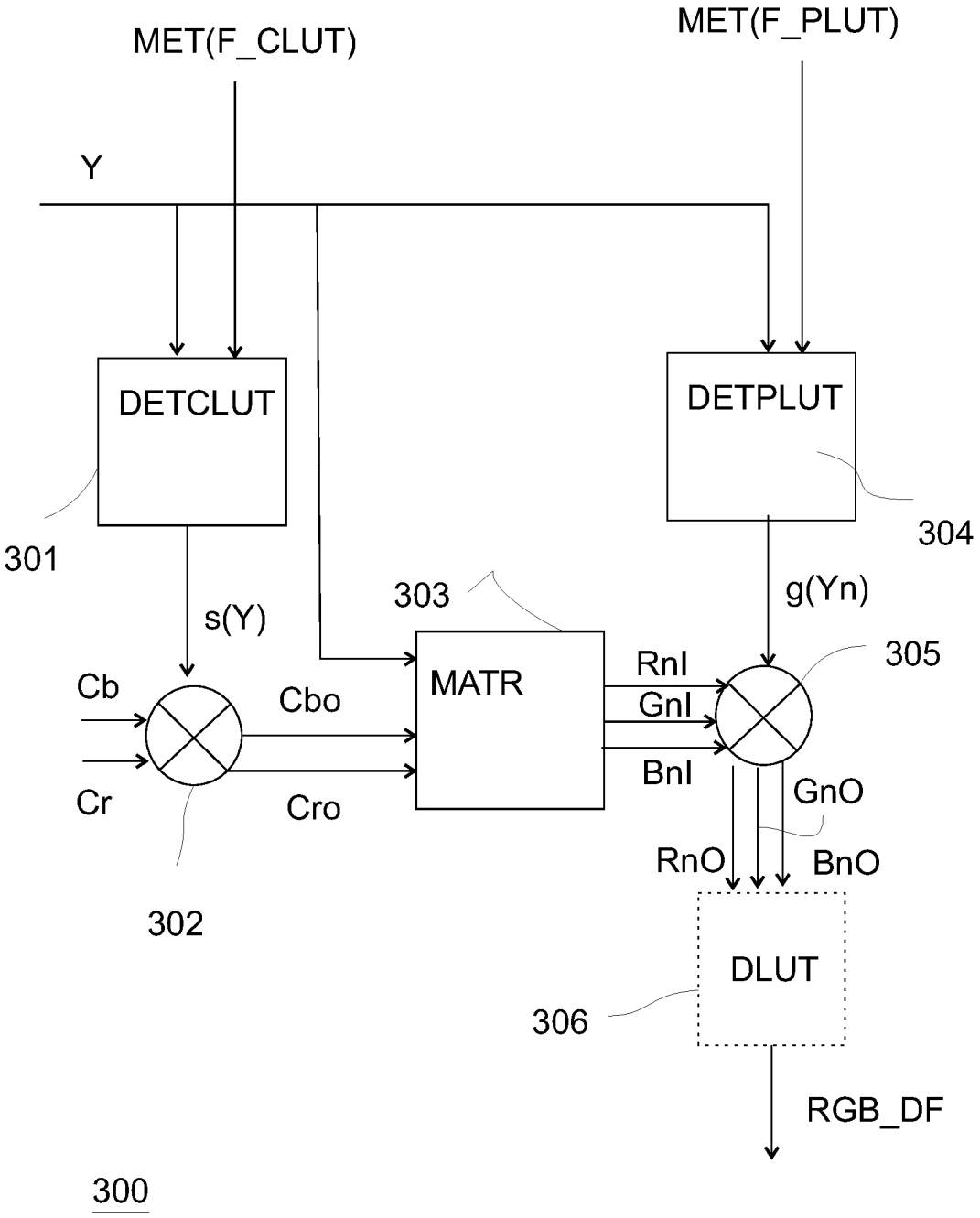
FIG. 3 shows a (non-limiting as regards the applicability of the present useful improvements) particularly useful dynamic range changing color processing core, which the present applicant standardized from his HDR video coding/decoding approach in various versions; this calculation circuit can also elegantly be used for not just HDR image decoding, but also display adaptation to obtain an optimal medium dynamic range image for a particular display of maximum displayable luminance PB_C which happens to be present at the premises of any particular viewer, e.g. by using as input a received or decoded version of the content creator's master HDR image, with YCbCr-coded pixel colors.

Finally, this function can be applied in the color processing core, e.g. the one elucidated with FIG. 3, so that the output lumas of the MDR image are obtained, based on the input lumas of the HDR image (or equivalently on could embody the calculation starting from the SDR image, be it with differently shaped combined luma mapping functions then).

Figure 8:
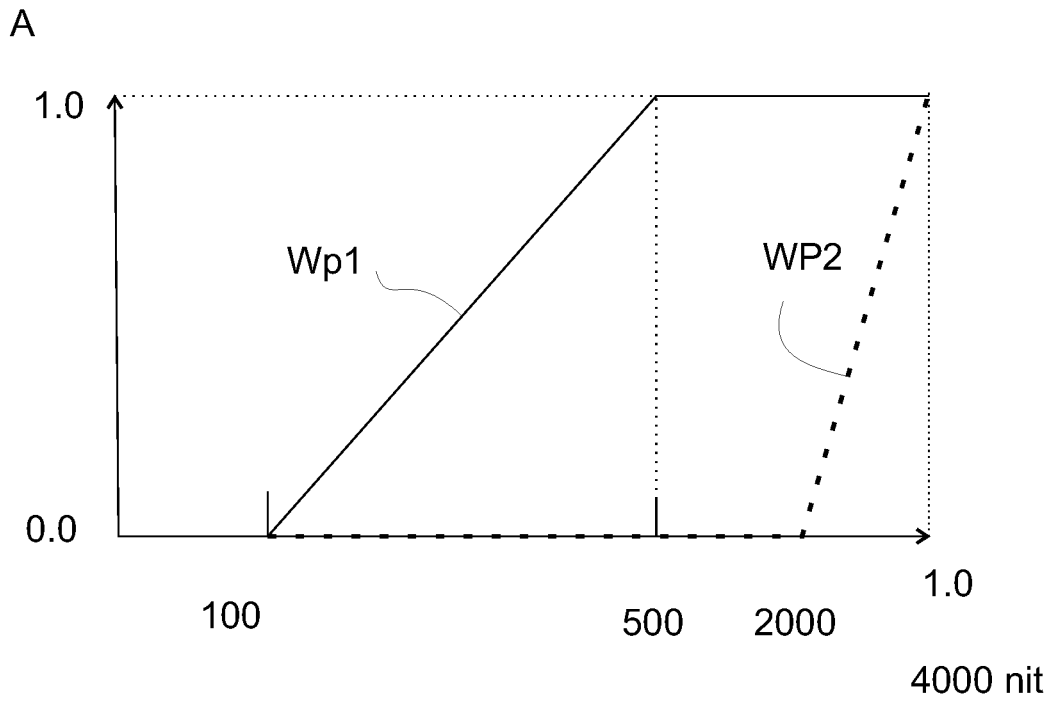
FIG. 8 shows some examples of the linear PB_D-based weight A determination function of FIG. 6, with some numerical values in nit.

FIG. 8 shows some practical examples, with some numerical luminance values superimposed. Typically the PB_D values will be judged, so the scale will end, at the PB_C value of the content, e.g. the movie, in this example 4000 nit. We show that also the weight factor determination curve may change (e.g. first weight determination curve WP1, and second weight determination curve WP2), e.g. depending on which type of image content is being processed, as some content may grade nicely on a larger subset of display PB_D's because it is less critical, and other content may start showing some problems later, etc. Although we elucidated the examples with a logarithmic definition of the perceptually uniform luma representation, the definition of the adjustment, and in particular the specification of the weight determination function, can also work in other non-linear representations.

The horizontal axis may also be described as the relative value of the PB_D (i.e. PB_D/PB_H) in a logarithmic system defined by PB_H as maximum (i.e. e.g. by means of equations 1, or a similar perceptual uniformization equation).

With function shape, or shape of a function, we mean the locus of the output points for various input points, i.e. e.g. a parabolic convex shape, which may be controlled by shape control parameters, like the values a, b, and c for an equation y out=a*x^2+b*x+c.

Figure 7:
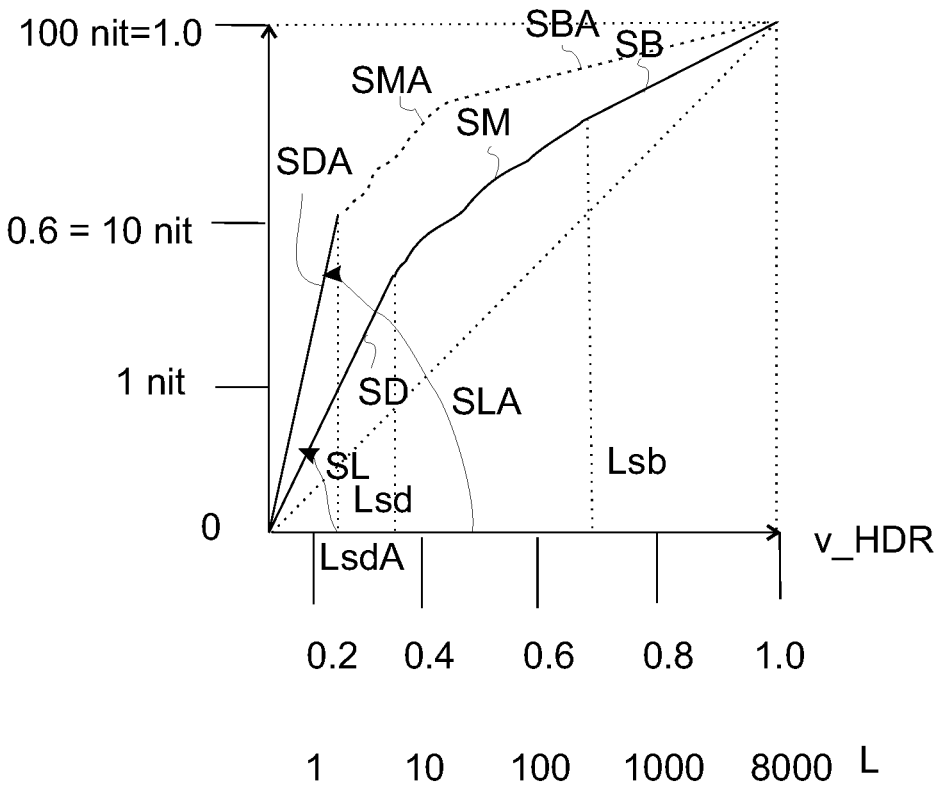
FIG. 7 further elucidates the general display adaptation adjustment approach, by focusing on a simple example (yet which may already solve an important majority of perceived or potentially occurring non-perfect behaviors of the static display adaptation) which proposes as alternative luma curve, a curve which(at least) has a different slope (called Shadowgain) for a specifically parametrized re-grading curve which is called a Para, e.g. Shadowgain_ALT=(1.k)* Shadowgain_content creator, where k is e.g. 1, 2, 3, 4, and Shadowgain_content creator is the Shadowgain of the Para which was selected as optimal for making an SDR grading of the present master HDR image, and communicated in receivers as metadata associated with the communicated image or video, and Shadowgain_ALT is the value proposed by the receiver for the adjustment, e.g. based on some measured luma properties of the currently color changed image.

FIG. 7 shows how one can elegantly and simply affect the brightness behaviour of the receiver's display adaptation behaviour by using an alternative Para-based adjustment.

The original Para of the content creator received as metadata has a dark segment SD ending at luma Lsd, and the bright linear segment SB starts at Lsb, and the middle (parabolically shaped) segment SM controls the grading of the middle range lumas.

An alternative grading Para is generated by the alternative luma mapping function determination unit 502, which has e.g. 1.3× steeper slope SL than the creator's Para's slope SL (a.k.a. Shadowgain) for its alternative dark segment SDA (or in general 1.x, or even 2.x, etc.). The rest of the function may be something else than a pure Para (e.g. a Para succeeded by some customized CC curve shape), but the alternative luma mapping function determination unit 502 could also determine e.g. a Highlight gain for the alternative brightest segment SBA, e.g. one which corresponds largely to the slope of the SB region, whilst allowing for some extra room for the darkest output lumas, in coordination with the determination of the alternative mid-region re-grading behavior of segment SMA. The other Para function shape control parameters like e.g. the Highlight gain may be equal for the alternative luma mapping Para and the original one or different, etc.

The algorithmic components disclosed in this text may (entirely or in part) be realized in practice as hardware (e.g. parts of an application specific IC) or as software running on a special digital signal processor, or a generic processor, etc.

It should be understandable to the skilled person from our presentation which components may be optional improvements and can be realized in combination with other components, and how (optional) steps of methods correspond to respective means of apparatuses, and vice versa. The word "apparatus" in this application is used in its broadest sense, namely a group of means allowing the realization of a particular objective, and can hence e.g. be (a small circuit part of) an IC, or a dedicated appliance (such as an appliance with a display), or part of a networked system, etc. "Arrangement" is also intended to be used in the broadest sense, so it may comprise inter alia a single apparatus, a part of an apparatus, a collection of (parts of) cooperating apparatuses, etc.

The computer program product denotation should be understood to encompass any physical realization of a collection of commands enabling a generic or special purpose processor, after a series of loading steps (which may include intermediate conversion steps, such as translation to an intermediate language, and a final processor language) to enter the commands into the processor, and to execute any of the characteristic functions of an invention. In particular, the computer program product may be realized as data on a carrier such as e.g. a disk or tape, data present in a memory, data travelling via a network connection—wired or wireless—, or program code on paper. Apart from program code, characteristic data required for the program may also be embodied as a computer program product.

Some of the steps required for the operation of the method may be already present in the functionality of the processor instead of described in the computer program product, such as data input and output steps.

It should be noted that the above-mentioned embodiments illustrate rather than limit the invention. Where the skilled person can easily realize a mapping of the presented examples to other regions of the claims, we have for conciseness not mentioned all these options in-depth. Apart from combinations of elements of the invention as combined in the claims, other combinations of the elements are possible. Any combination of elements can be realized in a single dedicated element.

Any reference sign between parentheses in the claim is not intended for limiting the claim. The word "comprising" does not exclude the presence of elements or aspects not listed in a claim. The word "a" or "an" preceding an element does not exclude the presence of a plurality of such elements.

The invention claimed is:

1. An image pixel luminance adaptation apparatus comprising:

a connection to a video decoder, wherein the video decoder is arranged to receive an encoded high dynamic range image and a metadata, wherein the high dynamic range image is encoded according to a first maximum codeable luminance, wherein the metadata specifies a first luma mapping function, wherein the first luma mapping function specifies the offsets of luminances of pixels of a secondary image relative to the luminances of pixels of the encoded high dynamic range image for collocated pixel positions, wherein the secondary image has a second maximum codeable luminance, wherein the video decoder is arranged to output a decoded high dynamic range image and the first luma mapping function;

a display adaptation circuit, wherein the display adaptation circuit is arranged to receive a value of a display maximum luminance, wherein the value of a display maximum luminance specifies a maximum luminance that a connected display can display;

wherein the display adaptation circuit is arranged to receive an input luma mapping function, wherein the display adaptation circuit is arranged to apply an algorithm, wherein the algorithm calculates a display adapted luma mapping function based on the input luma mapping function and the display maximum luminance, wherein the adapted luma mapping function corresponds in shape to the input luma mapping function but lies closer to a 45 degree increasing diagonal of a graph of the input luma mapping function in perceptually uniformized axes than the input luma mapping function, wherein the shape correspondence is such that a ratio of orthogonal distances to the diagonal of two points lying on the curve of the input luma mapping function equals a ratio of orthogonal distances of two points of the adapted luma mapping function, wherein two points of the adapted luma mapping function lie on the same two orthogonal projections;

an alternative luma mapping function determination circuit, wherein the alternative luma mapping function circuit is arranged to determine an alternative luma mapping function, wherein the display adaptation circuit comprises a combination circuit, wherein the combination circuit is arranged to combine the first luma mapping function and the alternative luma mapping function into a combined luma mapping function, wherein the display adaptation circuit is arranged to use the combined luma mapping function to yield an adapted combined luma mapping function; and a luma mapping circuit, wherein the luma mapping circuit is arranged to receive pixel lumas of the decoded high dynamic range image, wherein the luma mapping circuit is arranged to apply the adapted combined luma mapping function to the received pixel lumas so as to obtain output lumas of an output image.

2. The image pixel luminance adaptation apparatus as claimed in claim 1, wherein the combined luma mapping function has points on a combined luma mapping curve, wherein the alternative luma mapping function has points on an alternative luma mapping curve, wherein the first luma mapping function has points on a first luma mapping function curve, wherein the combined luma mapping curve is more similar in shape to the alternative mapping curve or more similar in shape to the first luma mapping curve, wherein the combined luma mapping curve becomes more similar in shape to the alternative mapping curve for lower values of the display maximum luminance.

3. The image pixel luminance adaptation apparatus as claimed in claim 2, wherein the combined luma mapping function is determined by linear weighting per luma value, wherein the linear weighting is defined as:

$$(1-A)*\mathrm{FL_50t1_1}(Vn)+A*\mathrm{ALT_FL_50t1_1}(Vn),$$

wherein FL_**50*t*1_1**(Vn) is the first mapping function, wherein Vn is a perceptually uniformized luma representation of a pixel luminance, wherein Vn is defined by applying a logarithmic function to the luminance, wherein A is a weight value between zero and one, wherein A is based on the value of the display maximum luminance, wherein A is equal to zero below a low display maximum luminance, wherein A is equal to one above a high display maximum luminance, wherein A is equal to a value between zero and one if the display peak brightness is between the low display maximum luminance and the high display maximum luminance according to a preset weighting profile shape.

4. The image pixel luminance adaptation apparatus as claimed in claim 3, wherein the preset weighting profile shape is a linearly increasing shape between zero and one when defined on an input axis, wherein the input axis is measured in the perceptually uniformized luma representation.

5. The image pixel luminance adaptation apparatus as claimed in claim 1, wherein the first luma mapping function consists of a first linear segment for a darkest sub-range of a total input luma range, wherein the linearity is fulfilled in the perceptually uniformized luma representation, wherein a second linear segment for a brightest sub-range of the total input luma range, wherein a non-linearly shaped non-decreasing segment for a middle sub-range is in between the first linear segment and the second linear segment, wherein the alternative luma mapping function comprises at least an alternative linear segment for the darkest sub-range, wherein the alternative linear segment has a slope different from a slope of the first linear segment for a darkest sub-range of the first luma mapping function.

6. The image pixel luminance adaptation apparatus as claimed in claim 1, wherein the alternative luma mapping function determination unit is arranged to determine an alternative luma mapping function, wherein the alternative luma mapping function has a curve, wherein the curve is the same as the curve of the first luma mapping function except for a shape perturbation for a sub-range of the input values.

7. The image pixel luminance adaptation apparatus as claimed in claim 1, wherein the distance to the diagonal of points on the curve of the adapted luma mapping function depends on the difference between the value of the display maximum luminance and the first maximum codeable luminance relative to the difference between the second maximum codeable luminance and the first maximum codeable luminance.

8. A method of pixel luminance adaptation comprising:

receiving an encoded high dynamic range image and metadata, wherein the encoded high dynamic range image is encoded according to a first maximum codeable luminance, wherein the metadata specifies a first luma mapping function, wherein the first luma mapping function specifies the offsets of luminances of pixels of a secondary image relative to the luminances of pixels of the encoded high dynamic range image for collocated pixel positions, wherein the secondary image has a second maximum codeable luminance, decoding the encoded high dynamic range image into a decoded high dynamic range image;

receiving a value of a display maximum luminance, wherein the value of a display maximum luminance specifies a maximum luminance that a connected display can display, determining an alternative luma mapping function;

combining the first luma mapping function and the alternative luma mapping function into a combined luma mapping function;

using the combined luma mapping function and the display maximum luminance as input for a display adaptation algorithm, wherein the display adaptation algorithm determines an adapted combined luma mapping function, wherein the combined luma mapping function has a combined luma mapping curve, wherein the combined luma mapping curve is the location of points mapping input lumas to output lumas by the combined luma mapping function;

wherein the adapted combined luma mapping function has an adapted combined luma mapping curve, wherein the adapted combined luma mapping curve corresponds in shape to the combined luma mapping curve but lies closer to a 45 degree increasing diagonal of a graph of the input luma mapping function in perceptually uniformized axes than the combined luma mapping function, wherein the shape correspondence is such that a ratio of orthogonal distances to the diagonal of two points lying on the curve of the adapted combined luma mapping function equals a ratio of orthogonal distances of two points of the combined luma mapping function, wherein two points of the adapted combined luma mapping function lie on the same two orthogonal projections, receiving pixel lumas of the decoded high dynamic range image; and applying the adapted combined luma mapping function to the pixels so as to obtain output lumas of an output image.

9. The method of image pixel luminance adaptation as claimed in claim 8, wherein the combined luma mapping function has a combined luma mapping curve, wherein the alternative luma mapping function has an alternative luma mapping curve, wherein the first luma mapping function describes a first luma mapping function curve, wherein the combined luma mapping curve is more similar in shape to the alternative mapping curve or more similar in shape to the first luma mapping curve, wherein the combined luma mapping curve is being more similar in shape to the alternative mapping curve for lower values of the display maximum luminance.

10. The method of image pixel luminance adaptation as claimed in claim 9, wherein the combined luma mapping function is determined by linear weighting per luma value, wherein the linear weighting is defined as:

$$(1-A)*\mathrm{FL_50t1_1}(Vn)+A*\mathrm{ALT_FL_50t1_1}(Vn),$$

wherein FL_50t1_1(Vn) is the first luma mapping function, wherein Vn is a perceptually uniformized luma representation of a pixel luminance, wherein Vn is defined by applying a logarithmic function to the luminance, wherein A is a weight value between zero and one, wherein A is based on the value of the display maximum luminance, wherein A is equal to zero below a low display maximum luminance, wherein A is equal to one above a high display maximum luminance, wherein A is equal to a value between zero and one if the display peak brightness is between the low display maximum luminance and the high display maximum luminance according to a preset weighting profile shape.

11. The method of image pixel luminance adaptation as claimed in claim 10, wherein the preset weighting profile shape is a linearly increasing shape between zero and one when defined on an input axis, wherein the present weighting profile shape is quantified in the perceptually uniformized luma representation.

12. The method of image pixel luminance adaptation as claimed in claim 8, wherein the first luma mapping function comprises a first linear segment for a darkest sub-range of a total input luma range, wherein the linearity is fulfilled in the perceptually uniformized luma representation, wherein the first luma mapping function comprises a second linear segment for a brightest sub-range of the total input luma range, wherein a non-linearly shaped non-decreasing segment for a middle sub-range is in between the first linear segment and the second linear segment, wherein the alternative luma mapping function comprises at least an alternative linear segment for the darkest sub-range, wherein the alternative linear segment which has a slope different from a slope of the first linear segment for a darkest sub-range of the first luma mapping function.

13. A computer program stored on a non-transitory medium, wherein the computer program when executed on a processor performs the method as claimed in claim 8.

14. The image pixel luminance adaptation apparatus as claimed in claim 8, wherein the distance to the diagonal of points on the curve of the adapted combined luma mapping function depends the difference between the value of the display maximum luminance and the first maximum codeable luminance relative to the difference between the second maximum codeable luminance and the first maximum codeable luminance.

15. An image pixel luminance adaptation apparatus comprising:

a connection to a video decoder, wherein the video decoder is arranged to receive an encoded high dynamic range image and a metadata, wherein the high dynamic range image is encoded according to a first maximum codeable luminance, wherein the metadata specifies a first luma mapping function, wherein the first luma mapping function specifies the offsets of luminances of a portion of pixels of a secondary image relative to the luminances of pixels of the encoded high dynamic range image for collocated pixel positions, wherein the secondary image has a second maximum codeable luminance, wherein the video decoder is arranged to output a decoded high dynamic range image and the first luma mapping function;

a display adaptation circuit, wherein the display adaptation circuit is arranged to receive a value of a display maximum luminance, wherein the value of a display maximum luminance specifies a maximum luminance that a connected display can display;

wherein the display adaptation circuit is arranged to receive an input luma mapping function, wherein the display adaptation circuit is arranged to apply an algorithm, wherein the algorithm calculates a display adapted luma mapping function based on the input luma mapping function and the display maximum luminance, wherein the adapted luma mapping function corresponds in shape to the input luma mapping function but lies closer to a 45 degree increasing diagonal of a graph of the input luma mapping function in perceptually uniformized axes than the input luma mapping function, wherein the shape correspondence is such that a ratio of orthogonal distances to the diagonal of two points lying on the curve of the input luma mapping function equals a ratio of orthogonal distances of two points of the adapted luma mapping function, wherein two points of the adapted luma mapping function lie on the same two orthogonal projections;

an alternative luma mapping function determination circuit, wherein the alternative luma mapping function circuit is arranged to determine an alternative luma mapping function, wherein the display adaptation circuit comprises a combination circuit, wherein the combination circuit is arranged to combine the first luma mapping function and the alternative luma mapping function into a combined luma mapping function, wherein the display adaptation circuit is arranged to use the input luma mapping function together with the combined luma mapping function to yield an adapted combined luma mapping function; and a luma mapping circuit, wherein the luma mapping circuit is arranged to receive pixel lumas of the decoded high dynamic range image, wherein the luma mapping circuit is arranged to apply to the received pixel lumas to the adapted combined luma mapping function so as to obtain output lumas of an output image.

16. A method of pixel luminance adaptation comprising:

receiving an encoded high dynamic range image and metadata, wherein the encoded high dynamic range image is encoded according to a first maximum codeable luminance, wherein the metadata specifies a first luma mapping function, wherein the first luma mapping function specifies the offsets of luminances of a portion of pixels of a secondary image relative to the luminances of pixels of the encoded high dynamic range image for collocated pixel positions, wherein the secondary image has a second maximum codeable luminance, decoding the encoded high dynamic range image into a decoded high dynamic range image;

receiving a value of a display maximum luminance, wherein the value of a display maximum luminance specifies a maximum luminance that a connected display can display, determining an alternative luma mapping function;

combining the first luma mapping function and the alternative luma mapping function into a combined luma mapping function;

using the combined luma mapping function and the display maximum luminance as input for a display adaptation algorithm, wherein the display adaptation algorithm determines an adapted combined luma mapping function, wherein the combined luma mapping function has a combined luma mapping curve, wherein the combined luma mapping curve is the location of points mapping input lumas to output lumas by the combined luma mapping function;

wherein the adapted combined luma mapping function has an adapted combined luma mapping curve, wherein the adapted combined luma mapping curve corresponds in shape to the combined luma mapping curve but lies closer to a 45 degree increasing diagonal of a graph of the input luma mapping function in perceptually uniformized axes than the combined luma mapping function, wherein the shape correspondence is such that a ratio of orthogonal distances to the diagonal of two points lying on the curve of the adapted combined luma mapping function equals a ratio of orthogonal distances of two points of the combined luma mapping function, wherein two points of the adapted combined luma mapping function lie on the same two orthogonal projections, receiving pixel lumas of the decoded high dynamic range image; and applying the adapted combined luma mapping function to the pixels so as to obtain output lumas of an output image.

* * * * *